US008426010B2

(12) United States Patent
Stadthagen-Gonzalez

(10) Patent No.: US 8,426,010 B2
(45) Date of Patent: Apr. 23, 2013

(54) STRUCTURAL ELEMENT

(76) Inventor: Klaus Stadthagen-Gonzalez, Houston, TX (US)

( * ) Notice: Subject to any disclaimer, the term of this patent is extended or adjusted under 35 U.S.C. 154(b) by 159 days.

(21) Appl. No.: 12/919,444

(22) PCT Filed: Feb. 25, 2009

(86) PCT No.: PCT/US2009/035160

§ 371 (c)(1),
(2), (4) Date: Aug. 25, 2010

(87) PCT Pub. No.: WO2009/108712

PCT Pub. Date: Sep. 3, 2009

(65) Prior Publication Data

US 2011/0005165 A1 Jan. 13, 2011

Related U.S. Application Data

(60) Provisional application No. 61/067,293, filed on Feb. 26, 2008.

(51) Int. Cl.
*B32B 3/12* (2006.01)

(52) U.S. Cl.
USPC ..... 428/178; 428/116; 428/119; 52/783.11

(58) Field of Classification Search ..... 52/783.11, 52/783.17, 783.18, 783.19, 790.1, 793.11; 428/116, 119, 428
See application file for complete search history.

(56) References Cited

U.S. PATENT DOCUMENTS

| | | | | |
|---|---|---|---|---|
| 2,423,756 | A | 7/1947 | Chaplin | |
| 2,481,046 | A | 9/1949 | Scurlock | |
| 2,771,164 | A | 11/1956 | Scurlock | |
| 2,809,908 | A | 10/1957 | French | |
| 3,842,768 | A | 10/1974 | Maistre | |
| 3,869,778 | A * | 3/1975 | Yancey | 428/573 |
| 4,297,820 | A | 11/1981 | Artzer | |
| 4,397,902 | A | 8/1983 | Resch | |
| 4,495,237 | A | 1/1985 | Patterson | |
| 4,909,003 | A | 3/1990 | Hennigan | |
| 4,984,384 | A | 1/1991 | Kaufmann | |
| 5,028,474 | A | 7/1991 | Czaplicki | |
| 5,128,195 | A * | 7/1992 | Hegedus | 428/174 |
| 5,162,143 | A * | 11/1992 | Porter et al. | 428/179 |

(Continued)

FOREIGN PATENT DOCUMENTS

| | | |
|---|---|---|
| EP | 63498 A1 | 10/1982 |
| GB | 2 035 895 | 6/1980 |

*Primary Examiner* — Jeanette E Chapman
*Assistant Examiner* — James Buckle, Jr.
(74) *Attorney, Agent, or Firm* — Fish & Richardson P.C.

(57) ABSTRACT

A structural element includes a continuous layer comprising a set of first main-faces defining a first surface and a set of second main-faces defining a second surface and the continuous layer extending between the first surface and the second surface, wherein along a first direction, the first main-faces and the second main-faces alternate in order and are connected by first side-faces, along a second direction different from the first direction, the first main-faces and the second main-faces alternate in order and are connected by second side-faces, and along a third direction different from the first direction and different from the second direction, a pair of neighboring first main-faces is connected by a first bridge-face, and the first bridge-face is connected to neighboring second main-faces by first bridge-side-faces.

48 Claims, 18 Drawing Sheets

U.S. PATENT DOCUMENTS

| | | | | |
|---|---|---|---|---|
| 5,424,113 | A | 6/1995 | Ray | |
| 5,444,959 | A * | 8/1995 | Tesch | 52/794.1 |
| 5,543,204 | A * | 8/1996 | Ray | 428/179 |
| 5,609,942 | A * | 3/1997 | Ray | 428/182 |
| 5,743,852 | A | 4/1998 | Johnson | |
| 5,894,045 | A | 4/1999 | Desrondiers | |
| 6,110,567 | A | 8/2000 | Bird | |
| 6,245,407 | B1 | 6/2001 | Wang et al. | |
| 7,010,897 | B1 | 3/2006 | Kuppers | |
| 7,541,085 | B2 * | 6/2009 | Burdon | 428/178 |

* cited by examiner

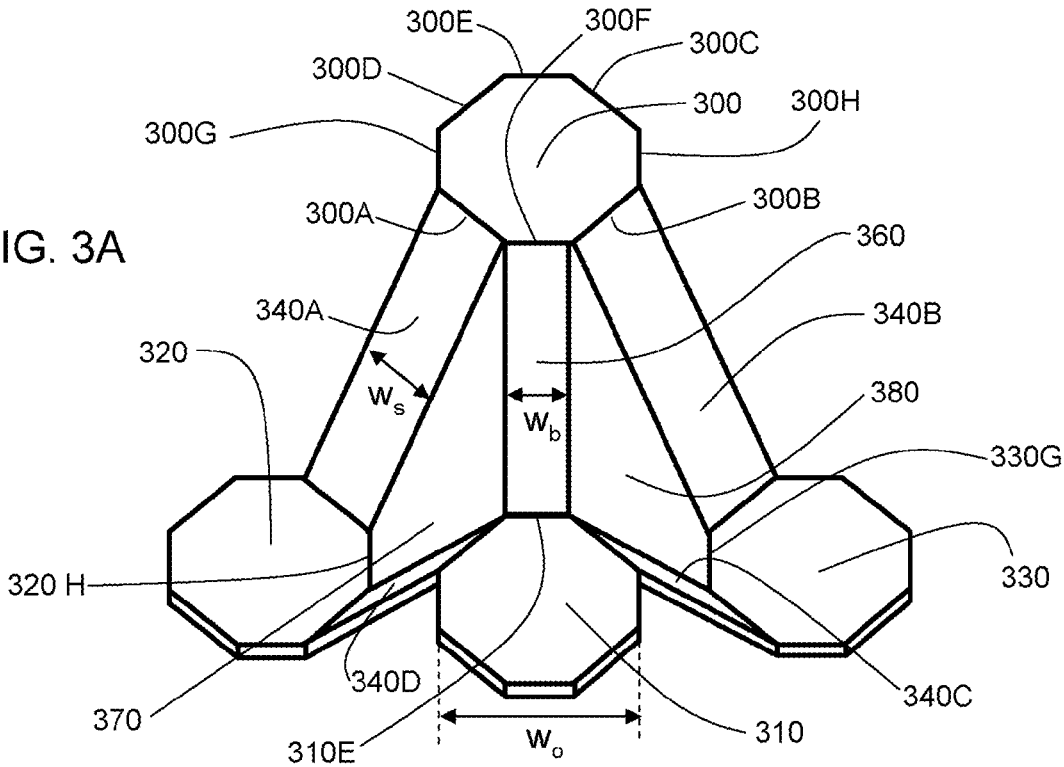
FIG. 3A
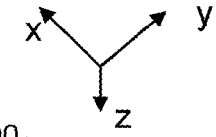
FIG. 3B
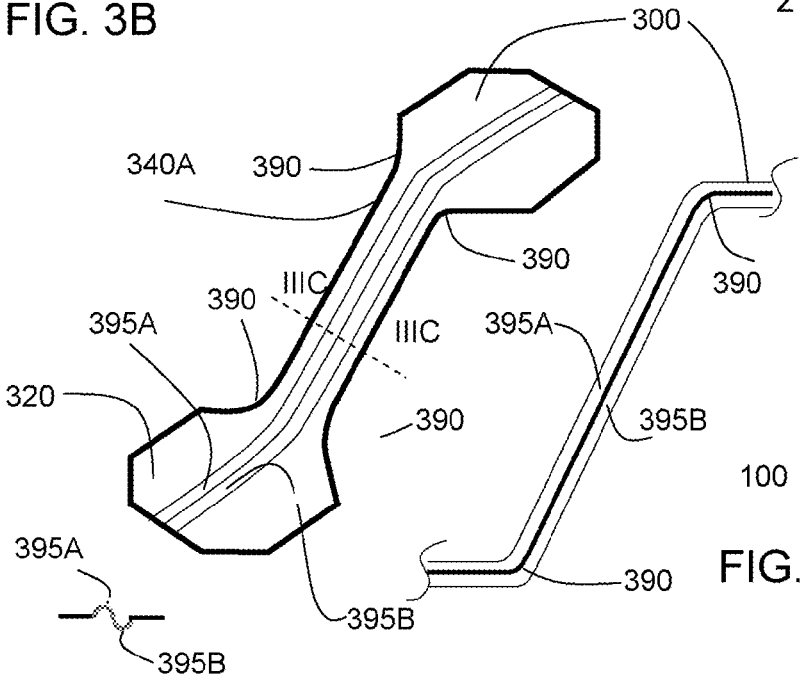
FIG. 3D
FIG. 3C 1600
z
y
1700
y
1750
1760
z
1720
1610B
1710B
x
x
1740
1790
1780
1610A
1610B
1710A
1720
1620
z 1720
1710B
1610A
1640
1740

STRUCTURAL ELEMENT

CROSS REFERENCE TO RELATED APPLICATIONS

This application is a national phase filing under 35 U.S.C. §371 of International application number PCT/US2009/035160, filed Feb. 25, 2009, which claims priority from provisional application No. 61/067,293 filed Feb. 26, 2008. The entire contents of the prior applications are incorporated herein by reference in their entirety.

TECHNICAL FIELD

This invention relates to structural configurations.

BACKGROUND

Three-dimensionally shaped structures are often used to provide stability and low weight, when, for example, applied in a sandwich structure.

Discrete structural systems of linear members arranged in triangular configurations in the form of trusses have been used to provide stability in two and more dimensions. As described in "Structural Steel Designer's Handbook," by Roger L. Brockenbrough and Federick S. Merrit, McGraw Hill, Third Edition, 1999, Section 3.27.1, a truss is "a structural system constructed of linear members forming triangular patterns." In general, a truss is composed of chord members and web members. As exterior members, the chord members define the profile of the truss, while the web members as interior members connect the chord members for transferring load from one chord member to the other. Examples of truss configurations include the Warren truss, the Howe truss, and the Pratt truss that, for example, are used in bridge structures.

For the ideal case that the axes of all linear members of a joint meet at a single point, and that the members are straight and connected through frictionless hinges, all the members are considered to be subject to axial load only, i.e., to tension or compression. If the members of a joint do not meet at a single point, additional bending moments can be generated at the ends of the linear members.

SUMMARY

The disclosure relates generally to methods and systems providing increased rigidity to structural elements. More specifically, the methods and systems employ one or more continuous layers for forming multidirectional truss-configurations based on the shape of the layer. The truss-configurations provide various paths for, e.g. transferring a force across and/or within the continuous layer. Multidirectional truss-configurations provide structural rigidity in many directions. Structural elements and systems including one or more structural elements can result in, for example, high strength and stiffness in the directions of the truss-configurations, thereby allowing a high strength to weight ratio.

In general, in one aspect, the invention features structural elements including a continuous layer comprising a set of first main-faces defining a first surface and a set of second main-faces defining a second surface and the continuous layer extending between the first surface and the second surface, wherein along a first direction, the first main-faces and the second main-faces alternate in order and are connected by first side-faces, along a second direction different from the first direction, the first main-faces and the second main-faces alternate in order and are connected by second side-faces, and along a third direction different from the first direction and different from the second direction, a pair of neighboring first main-faces is connected by a first bridge-face, and the first bridge-face is connected to neighboring second main-faces by first bridge-side-faces.

In another aspect, composite elements include a structural element, e.g., as described above, as a continuous core component, and a first face-sheet attached to the first main-faces of the structural element.

In another aspect, modular building systems include at least one structural element, e.g., as described above, at least one face-sheet for attaching to the at least one structural element, the at least one structural element and the face-sheet configured to form a channel when attached to each other, and at least one mount element for connecting two structural elements.

In another aspect, open lattice structures include at least two structural elements, e.g., as described above, and attached to each other at the main-faces, forming a channel system in-between the structural elements.

In another aspect, structural beams include at least one structural element, e.g., as described above, and two flanges attached to the main-faces of the structural element.

In another aspect, wall-elements include a structural element, e.g., as described above, and at least one chord element attached to the structural element for forming at least one truss-configuration with at least one of a first group of faces of the structural element including the first main-faces, the second main-faces, the first side-faces, and a second group of faces of the structural element including the second side-faces or the first main-faces, the second main-faces, the first bridge-faces, and the first bridge-side-faces.

In another aspect, damping elements include a structural element, e.g., as described above, made of elastic material and attached to two face-sheets.

In another aspect, structural elements include a continuous layer extending between a first surface and a second surface and formed to include truncated conical elements and truncated inverted conical elements alternating in order, wherein top main-faces of the truncated conical elements define the first surface, bottom main-faces of the inverted truncated conical elements define the second surface, side-faces each shared by a pair of a truncated conical element and a truncated inverted conical element, first bridge-faces each connecting a pair of top main-faces of neighboring truncated conical elements, first bridge-side-faces each connecting a pair of one of the first bridge-faces and the bottom main-face of a neighboring one of the inverted truncated conical elements, second bridge-faces each connecting a pair of bottom main-faces of neighboring truncated inverted conical elements, second bridge-side-faces each connecting a pair of one of the second bridge-faces and the top main-face of a neighboring one of the truncated conical elements.

Embodiments can include one or more of the following features and/or features of other aspects.

In certain embodiments, the continuous layer can be formed of the first main-faces, the second main-faces, the first side-faces, the second side-faces, the first bridge-faces, and the first bridge-side-faces.

In certain embodiments, the third direction can vary within the extension of the structural element.

In certain embodiments at least one of the first bridge-faces is leveled with the neighboring first main-faces.

In some embodiments, a thickness of a structural element given by a distance between the first surface and the second surface is larger than a thickness of the continuous layer itself.

Depending on the application, the thickness of the structural element can range, for example, from one or a few millimeter to several centimeter, decimeter, or even meter. The thickness of the continuous layer itself can range, for example, from a few fractions of a millimeter to several centimeter.

In some embodiments, at least one of the first bridge-faces can be configured to provide a two-dimensional contact area to the first surface and has a width of at least 2% of a width of one of the connected first main-faces. The width can also be, for example, at least 5%, 10%, 20%, 30% or more. The width of the at least one first bridge-face and the width of the one of the connected first main-faces can be defined orthogonal with respect to the leveled with the neighboring first main-faces.

In certain embodiments, the ratio of the area of one of the connectable bridge faces to the area of one of the connectable main-faces can be at least 2%, for example, at least 5%, at least 7%, at least 10%, at least 20%, and at least 30% or more. Due to the continuous transition between the faces, the shape of the main-face in direction to the bridge-face can be approximated based on the shape of the main-face at the transition to a side-face.

In certain embodiments, a pair of a neighboring side-face and a bridge-side-face connect under an angle.

In some embodiments, at least one of the first side-faces can be non-perpendicular with respect to at least one of the its respective first main-face and its respective second main-face.

In some embodiments, each of the first bridge-side-faces can extend from one of the sides of its respective first bridge-face to the side of its respective second main-face. At least one of the first main-faces, the second main-faces, the first side-faces, the second side-faces, and first bridge-side-faces can be planar and/or include a curved area. In certain embodiments, at least some of the first and second main-faces can be parallel while others can be non-parallel. At least in a partial region at least some of the first and second main-faces can be tilted with respect to each other.

In certain embodiments, at least one of the first surface and the second surface or the structural element itself can be curved. In certain embodiments, the structural element can be tubular.

In some embodiments, at least one of the first and second main-faces can have one of a polygon shape, a circular shape and an elliptical shape.

In some embodiments, in the plane of the first surface, the shape of at least one of the first bridge-faces can be one of rectangular, trapezoidal, polygon, and elongated having curved sides.

In some embodiments, along a fourth direction different from the first direction and different from the second direction, a pair of neighboring second main-faces can be connected by a second bridge-face, and the second bridge-face can be connected to neighboring second main-faces by second bridge-side-faces. The continuous layer can be formed in addition to the first main-faces, the second main-faces, the first side-faces, the second side-faces, the first bridge-faces, and the first bridge-side-faces by the second bridge-faces and second bridge-side-faces.

In certain embodiments, at least one of the second bridge-faces can be leveled with the neighboring second main-faces.

In some embodiments, at least one of the second bridge-side-face can be non-perpendicular with respect to at least one of its respective first bridge-face and its respective second main-face.

In some embodiments, at least in a partial region of the structural element the third direction and fourth direction can be identical or different. In some embodiments, the third direction and fourth direction can be changing from region to region of the structural element.

In some embodiments, at least one of the first main-faces, the second main-faces, the first side-faces, the second side-faces, the first bridge-faces, and the first bridge-side-faces can include one or more openings. Openings can further be provided on the second bridge-faces and the second bridge-side-faces. An opening can extend over at least 5% or more, for example, at least, 10%, at least 20%, at least 30%, and at least 40% or more.

Moreover, examples of shapes of the openings include a circular shape, an elliptical shape, an elongated shape, and a cross shape.

In certain embodiments, the structural element can be made of galvanized steel. In some embodiments, the structural element can be made of one or more layers. Example configurations include a central aluminum foil embedded in a resin, one or more fiber fabrics embedded in resin, several layers attached together (e.g., glued or welded).

In some embodiments, the opening can be configured to guide a rebar element for forming truss-configurations with the first main-faces, the second main-faces, the first side-faces, and the second side-faces or the first main-faces, the second main-faces, the first bridge-faces, and the first bridge-side-faces.

In some embodiments of the composite element, the second bridge-faces and the second bridge-side-faces of the structural element can form a channel of trapezoidal or trapezoidal-like cross-section with the first face sheet.

In some embodiments, a member can be inserted within the channel. In certain embodiments, the member can be formed to fill at least partly the channel. The member can be formed to fill an incremental rectangular area of the channel.

In certain embodiments, a face-sheet of the composite element, can have extensions that reach into recesses formed by tilted main-faces.

In some embodiments, the member can be formed to be in contact with at least two of its respective second bridge-face and second bridge-side-face and section of the first face-sheet. The member can be hollow.

In some embodiments, at least one of the first bridge-side-faces and the side-faces can be configured to reflect radiation. The member can be configured to be part of a heating system or of a solar-energy absorbing system.

In certain embodiments also the main-faces can be reflective, for example, through applying a reflective coating onto the surface of the structural element. Light reflected from the main-faces can further be reflected by internal reflection within the face-sheet and thereby can also be directed to the member.

In some embodiments, the first face-sheet can be configured to transmit radiation.

In some embodiments, composite elements can further include a second face-sheet attached to the second main-faces of the structural element.

In some embodiments of modular building systems, at least one mount element can one of a corner post with pins configured for inserting into the channel, a U-connector, and an angled connector structural element.

In some embodiments, open lattice structures include a face-sheet in-between two neighboring structural elements. The at least two structural elements can be rotated with respect to each other. At least two of the structural elements can be structurally identical or different.

In some embodiments, one or more structural elements of structural beams include at least two main-faces across a width of the structural beam. The material of the flanges can be a material with a high tensile strength. Examples include, e.g., galvanized steel.

In some embodiments, a chord element of wall-elements can be one of a wire-mesh and a rebar. The rebar can be attached to main-faces of the structural element. The rebar can be positioned between the first and second main-faces of the structural element. The rebar can be guided through openings within the structural element. Example materials for a rebar include steel.

In some embodiments, chord elements can be one of a drywall, a fiber reinforced polymer wall, a cement plate, galvanized steel, and a wood board.

In some embodiments, the chord element and the structural element can form a channel system configured for inserted connectors, wherein the channel system is configured such the connectors form themselves a truss configuration.

The wall element can further include two structural elements and a face-sheets in-between the two structural elements.

In some embodiments, structural elements include truncated conical elements having a pyramid-shape.

In some embodiments, structural elements the top main-faces of the truncated elements, the bottom main-faces of the inverted truncated elements, the side-faces, the bridge-faces, and the bridge-side-faces can form a continuous surface.

In some embodiments, the shape of the continuous layer can allow bending the structural element to form or reinforce round or curved structures. For embodiments with high symmetry, easy stacking of the structural elements can reduce transportation costs.

In addition, one or more structural elements can result in open structures that provide a system of channels, which can be used for various purposes. In some embodiments, the channels are used for connecting two structural elements. In some embodiments, a channel can form a communicating passageway within the plane of the structural element. The passageway can allow moisture to drain and, thereby, reduce deteriorating of the structural elements (e.g., by reducing the tendency for corrosion). Additionally or alternatively, a channel can form a passageway for transportation purposes, such as for transporting fluids. In some embodiments, various elements can be introduced in a guided manner in a channel. For example, one can place different types of cables, conduits, tubes, and the like within a channel of the open structure. Moreover, a channel can be filled with a material, such as a low density material (e.g., foam) or a solid. Furthermore, a channel can be filled with a liquid or gas for heat transfer purposes, as well as for the flow of electricity, for example, when filled with an electrolyte.

In some embodiments, the type of material of the structural element provides, for example, low or high conductivity (e.g. heat conductivity or electrical conductivity) along the channel.

The details of one or more embodiments are set forth in the accompanying drawings and the description below. Other features, objects, and advantages will be apparent from the description and drawings, and from the claims.

BRIEF DESCRIPTION OF DRAWINGS

FIG. 3A is a view of a section of FIG. 1.

FIG. 3B is a view of a section of FIG. 3A showing reinforcing indentations.

FIG. 3C is a view of a first cross section of FIG. 3B.

FIG. 3D is a view of a second cross section of FIG. 3B.

Like reference symbols in the various drawings indicate like elements.

DETAILED DESCRIPTION

In the following, geometries of various structural elements are described by dividing a surface of the Structural Element into several faces. A face can be understood as a section of the surface having a common feature. Examples of common features include a common geometrical orientation in the three-dimensional space and common neighboring types of faces. Neighboring faces are connected with each to provide a continuous transition of the structural element from one section to the other.

Figure 1:
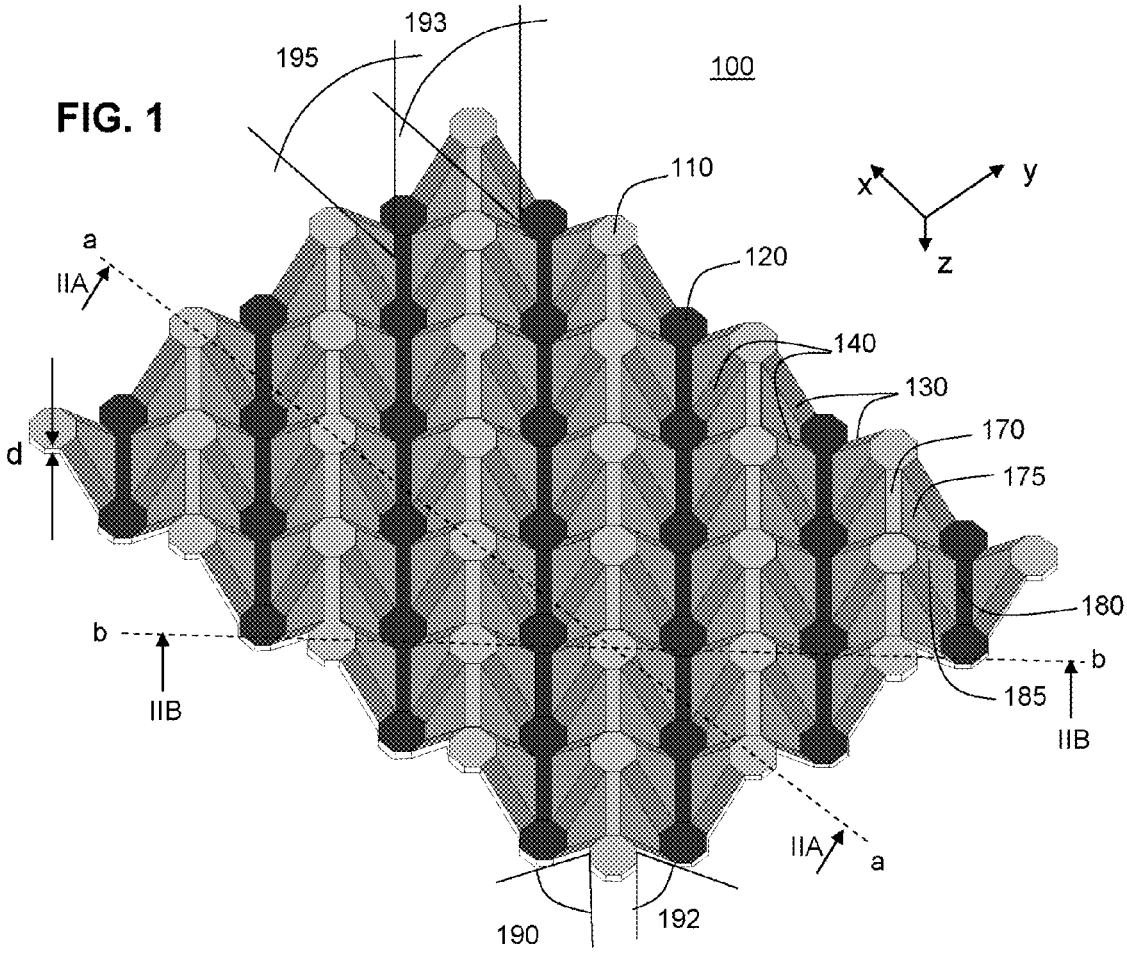
FIG. 1 is a projection view of an embodiment of a structural element.

Referring to FIG. 1, a three-dimensional structural element 100 extends in the x-y-z space of the indicated coordinate system. In general, element 100 can be made from of one or multiple continuous layers of material(s), e.g., a solid or composite material. The layer itself has a thickness d in z-direction.

Element 100 is formed to include a first set of main-faces 110 and a second set of main-faces 120. In x-direction, first and second main-faces 110 and 120 alternate in order and two successive main-faces are connected through a first side-face 130. In y-direction, first and second main-faces 110 and 120 also alternate in order and two successive main-faces are connected through a second side-face 140.

Figure 2A:
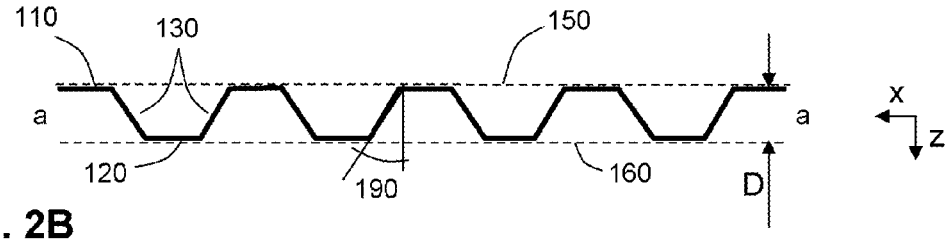
FIG. 2A is a schematic showing a first profile of the embodiment of FIG. 1.

Referring to FIG. 2A, a profile of element 100 along a line a-a as indicated in FIG. 1 (i.e., along the x-direction) illustrates a sequence of first main-faces 110, first side-faces 130, and second main-faces 120 that forms a continuous layer in a truss-web like configuration. A profile along the y-direction would show a similar sequence of first main-faces 110, second side-faces 140, and second main-faces 120.

Accordingly, first side-faces 130 and second side-faces 140 connect successive main-faces that, in z-direction, are on different sides of element 100. Thus, in x- and y-direction, element 100 can provide first and second side-faces 130 and 140 as a truss-web for building truss-like configurations in, e.g., a sandwich-structure. In such a sandwich-structure, truss-like configurations based on first and second side-faces 130 and 140 can stabilize in directions in and close to x- and y-direction as well as in z-direction.

As shown in FIG. 2A, main-faces 110 define a first surface plane 150 on a first side of element 100. Similarly on a second side of element 100, a second surface plane 160 is defined by main-faces 120. Main-faces 110 and 120 provide contact to surface planes 150 and 160. As further shown in FIG. 2A, a distance D between first surface plane 150 and second surface plane 160 defines the height (also referred as rise or depth) of structural element 100, which in the embodiment of FIG. 1 is constant over the x-y-plane.

Referring again to FIG. 1, the structure of element 100 includes further first bridge-faces 170, which connect successive first main-faces 110, and second bridge-faces 180, which connect successive second main-faces 120. As each of the bridge-faces 170 and 180 connects successive main-faces on the same side of element 100, the direction of connection via bridge-faces 170 and 180 differs from the direction of connection between successive main-faces, which are on opposite sides of element 100. In the example of FIG. 1, the direction of connection via bridge-faces 170 and 180 is at an angle of 45° with respect to the x-direction and the y-direction.

In addition, first bridge-faces 170 (on the first side of element 100) are connected to successive second main-faces 120 (on the second side of element 100) through bridge-side-faces 175. Similarly, second bridge-faces 180 (on the second side of element 100) are connected to successive first main-faces 110 (on the first side of element 100) through bridge-side-faces 185. Each of the bridge-side-faces 185 connects a pair of successive first and second side-faces.

Based on bridge-faces 170 and 180 and bridge-side-faces 175 and 185, element 100 can provide for truss-web like configurations in additional directions that deviate from the x-direction and the y-direction.

Figure 2B:
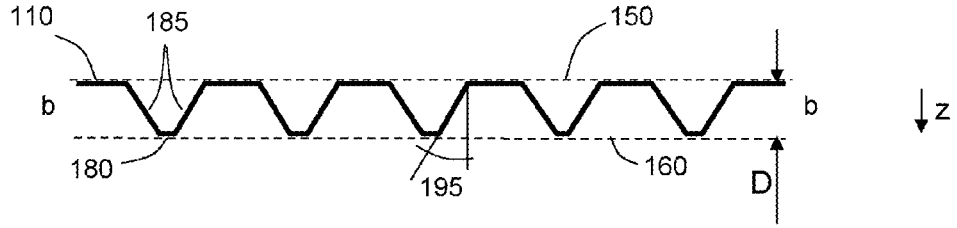
FIG. 2B is a schematic showing a second profile of the embodiment of FIG. 1.

To illustrate the additional truss-web like configurations, FIG. 2B shows a profile of element 100 along a line b-b as indicated in FIG. 1. Line b-b runs under an angle of 45° to the x- and y-directions. The truss-like configurations are based on a sequence of first main-faces 110, second bridge-side-faces 185, and second bridge-faces 180. A profile along the same direction but through second main-faces 120 would show a similar shape but inverted in z-direction.

Selective for the truss-web configurations in multiple directions, the profiles shown in FIGS. 2A and 2B indicate two truss-web configurations as an example.

The truss-web like configurations of the structural element, when attached to a first face-sheet in plane 150 and a second face-sheet in plane 160, acts as the web in a truss configuration, transferring load from one plane to the other. Because the truss-web like configuration is present in multiple directions, the load is also transferred in multiple directions, allowing for better distribution and lower stress. Some of the faces in element 100 will be at tension, and some others at compression, depending on the direction of the applied force.

Moreover, first bridge-faces 170 and second bridge-faces 180 provide additional two-dimensional contact areas with first surface plane 150 and second surface plane 160, respectively. When exposed to a load, a larger contact surface area decreases the load per unit of area and, therefore, distributes and transmits the load more than a small contact surface. In addition, the additional contact area can strengthen the connection between element 100 and an attached face-sheet because the face-sheet is not only attached to, e.g., first main-faces 110 but also to bridge-faces 170. In addition, a larger contact surface can increase the skin deformation strength of the face-sheets.

An alternative way to look at three-dimensional continuous structural element 100 is based on truncated pyramidal elements and inverted truncated pyramidal elements that form peaks (main-faces 110) and valleys (main-faces 120). The truncated pyramidal elements and inverted truncated pyramidal elements share side-faces 130 and 140, which are sides of the pyramids. Neighboring peaks and valleys are connected to one another through a series of continuous surface connections by bridge-faces 170 and 180. Due to the continuous surface connections, peaks and valleys are not isolated peaks and valleys, but a chain or range of mountains.

The truncated pyramidal elements and the continuous surface connections provide for the truss-configurations in multiple directions when attached, e.g., to face-sheets: In x- and y-directions, side-faces 130 descend diagonally from peaks to valleys at a given first angle 190 with respect to the z-direction, and side-faces 140 descend diagonally from valleys to peaks at a second angle 192 with respect to the z-direction. In the diagonal directions (in between x- and y-directions), bridge-side-faces 175 formed between the bridge-faces 170 and the peaks and valleys descend at a third angle 193 with respect to the z-direction, and bridge-side-faces 185 descend at a fourth angle 195 with respect to the z-direction.

Element 100 can also be used alone as a stand alone unit because the truncated pyramids have some rigidity themselves, which largely depends on the material, dimensions and thickness.

The various faces of element 100 (e.g., main-faces 110, 120, side-faces 120, 130, bridge-faces 170, 180, and bridge-side-faces 175, 185) can vary in size and angle (e.g., continuously or step-wise) over element 100. Also, the inclination of the bridge-side-faces and side-faces (e.g., angles 190, 192, 193, and 195) can vary over the element. Additionally or alternatively, in some embodiments, the various faces of element 100 can vary in shape and may be located in different planes, and even have different curvatures. The variation in size, shape and angles can adapt element 100 to the demands of a specific application and, e.g., change the load transmission patterns from one side to the other, and/or adjust to different tridimensional surfaces 150 and/or 160.

FIG. 3A illustrates a segment of element 100 in more detail. The segment includes two first main-faces 300 and 310 (on the first side) and two second main-faces 320 and 330 (on the second side), which are shaped as octagons. Four sides 300A-300D of the eight sides of main-face 300 connect to four main-faces (on the second side) through four side-faces. For example, sides 300A and 300B of main-face 300 are connected to second main-faces 320 and 330 via side-faces 340A and 340B, respectively. Similarly, main-face 310 is connected via side-faces 340C and 340D to second main-faces 320 and 330, respectively.

To provide for those additional truss-web configuration, sides 300E and 310F of main-faces 300 and 310, respectively, are connected via bridge-face 360. Bridge-face 360 (on the first side) is connected with main-faces 320 and 330 (on the second side) via bridge-side-faces 370 and 380. In FIG. 3A, this is illustrated by sides 330G and 320H of main-faces 330 and 320 that are connected with the side-lines of bridge-face 360 through bridge-side-faces 370 and 380, respectively.

Additionally, a width $w_s$ of the side-faces, a width $w_b$ of the bridge-faces, and a width $w_o$ of the octagonal main-faces are indicated in FIG. 3A. In the embodiment of FIG. 3A, the width $w_s$ of the side-faces is larger than the width $w_b$ of the bridge-faces. The width $w_b$ of the bridge-faces is about ⅓ of a width $w_o$ of the octagonal main-faces, while the width $w_s$ of the side-faces is about ½ of the width $w_o$ of the octagonal main-faces. These widths can vary according to the specific application. They partially define the main-faces dimensions since they are directly linked to at least six of their eight sides, as can be seen in FIG. 1. For certain structural applications, these widths should be designed to allow for adequate bonding or joining of the structural element to face-sheets or neighboring structural elements. Moreover, the width can be designed to limit any eccentricity generated in cases where the axes of the side-faces and/or the bridge-side-faces do not converge at a single point on the plane of the main-faces or within a connected face-sheet. In general, the width of a bridge-face can be 90%, 80%, 70%, 60%, 50%, 40%, 30%, 20%, or 10% or less of the width $w_o$ of a connected main-face.

In an ideal truss, members are subject only to "axial forces," i.e., forces along their axes, and all members converge at a "joint" such that the axes of the members cross at a single point in space. Depending on the angles and thickness of the structural element and any connected face-sheets, the axes of the main-faces, bridge-faces, side-faces, and bridge-side faces may not converge meet in the plane of the main-faces, bridge faces or an attached face-sheet. Then a converging point may be above the main-faces, at a distance that depends on the size of the main-faces and the bridge-faces. Thus, eccentricity may be generated that causes some moments at the transitions between the faces. The moments can cause deformation of the side-faces, bridge-side-faces. Specific shapes of the faces and transitions as as well as using stabilizing members can counteract such deforming forces.

For example, FIGS. 3B to 3D illustrate two approaches to counteract moments caused by deviations from the ideal truss for an embodiment of side-face 340A in more detail. Specifically, FIG. 3B shows S-shaped indentations 395A, 395B that can increase rigidity, for example, when the structural element is formed of thin sheets of material. FIG. 3C shows a cross section of side-faces 340A as indicated in FIG. 3B. The increased rigidity provided by indentations 395A, 395B can counteract bending moments generated at the ends of side-faces by an eccentric loads. Other forms of indentations and joint designs can be devised for the same purpose.

FIG. 3D shows further are rounded transitions 390 from side-face 340 to main-faces 300 and 320 that can reduce stress concentration in the transition areas.

Figure 4:
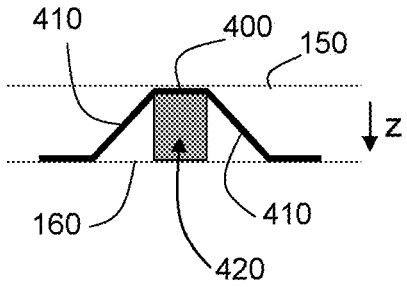
FIG. 4 is a schematic showing a profile of a trapezoidal structure based on two bridge-faces and one main-face.
Figure 26:
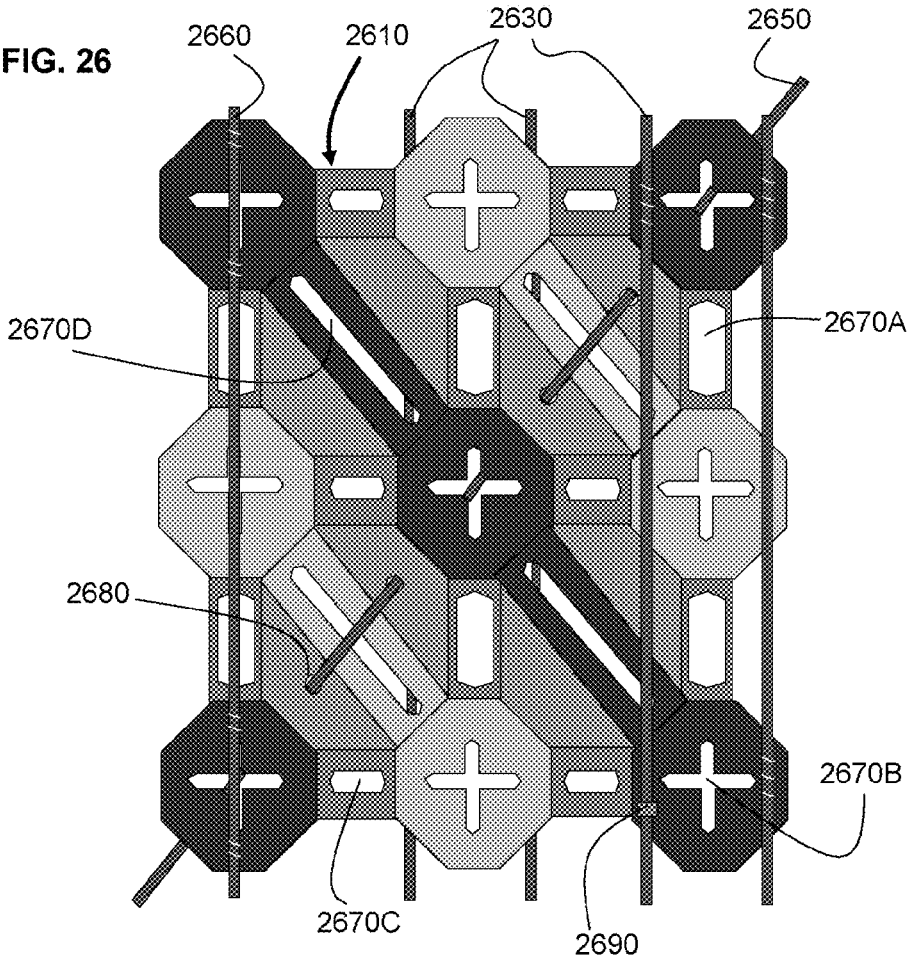
FIG. 26 is side view of a first embodiment of a structural element with openings and elongated reinforcing elements.

As shown in FIG. 4, the extension of bridge-face 400 in the x-y-plane generates a channel of a trapezoidal profile between element 100 and second surface 160. Specifically, bridge-face 400 and bridge-side-faces 410 form a trapezoidal shaped channel that includes an incremental rectangular area 420. In general, channels can be used for various purposes including stabilizing structural element 100 by inserting a stabilizing member having a cross-section that touches the inside-walls of the channel in more than one point, e.g., stabilizing members that are adapted to the trapezoidal profile 2600A, a rectangular profile 2600B 420, or have an adapted circular profile 2600C as illustrated in FIG. 26.

Figure 5A:
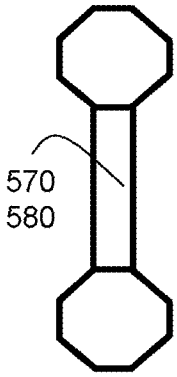
FIG. 5A is a schematic illustration of a first shape of a bridge-face.
Figure 5B:
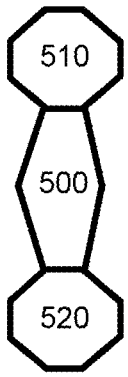
FIG. 5B is a schematic illustration of a second shape of a bridge-face.
Figure 5C:
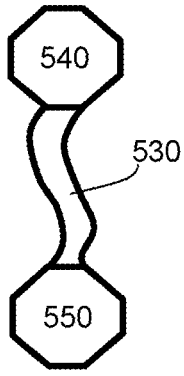
FIG. 5C is a schematic illustration of a third shape of a bridge-face.

Additional shapes of faces of the structural element are shown in FIGS. 5B and 5D. While in FIG. 1 and FIG. 5A, bridge-faces 170 and 180 are rectangular and do not vary in size or shape, others shapes and sizes are also possible. As shown in FIG. 5B, the width $w_b$ of a bridge-face 500 increases towards an intermediate position between main-faces 510 and 520. Accordingly, also the shape of the corresponding bridge-side-faces deviates from the shape shown in FIG. 1. Another example of a non-rectangular bridge-face 530 is shown in FIG. 5C. Bridge-face 530 meanders from a main-face 540 to a main-face 550 with varying width.

Figure 27:
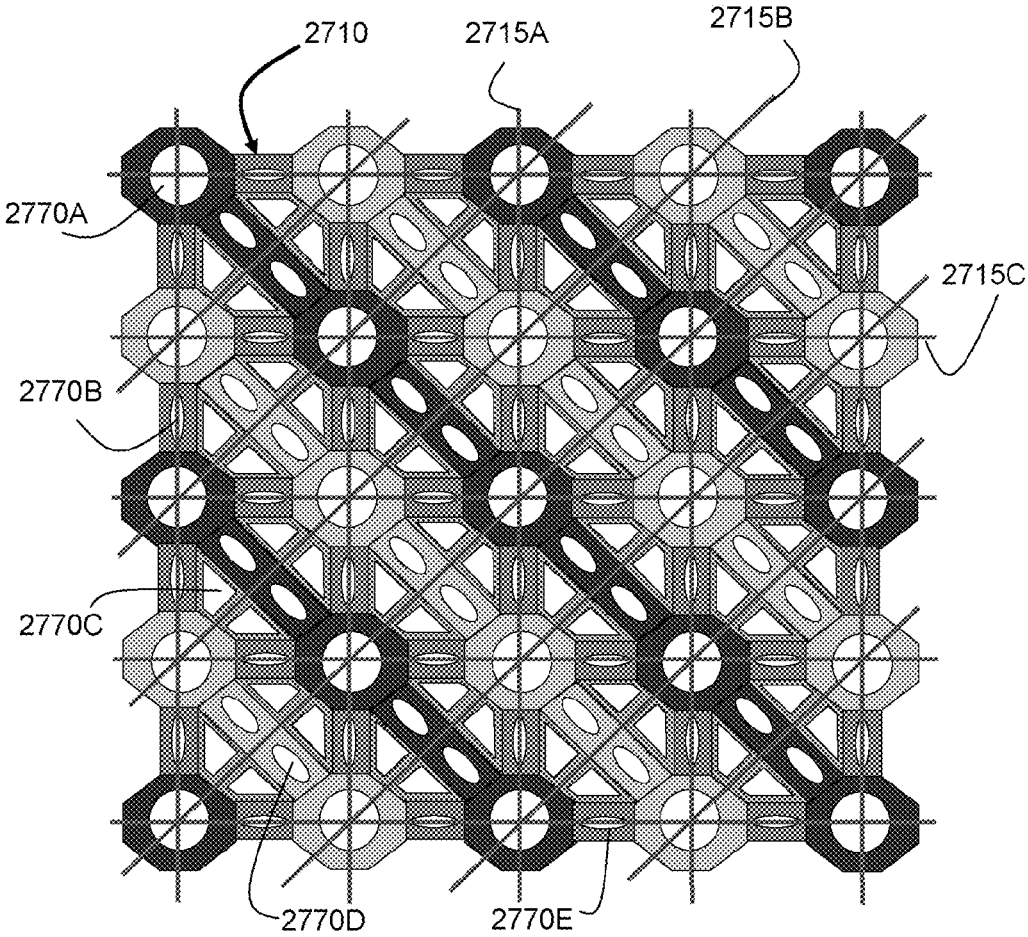
FIG. 27 is side view of a second embodiment of a structural element with openings and elongated reinforcing elements.

Similarly, in some embodiments, the faces can have flat and smooth surface. Alternatively, in some embodiments, the faces, for example, main-faces 110, 120 and bridge-faces 170, 180 of FIG. 1 can have indentations, which can be used for interlocking those main-faces with an attached face-sheet, as in FIG. 3B. Additionally or alternatively, the faces can have a rough or concave surface to improve glued connections to such a face-sheet. Moreover, one can provide holes within the structural element to accommodate rivets, bolts, or other mechanical fasteners, as well as to reduce the use of material in places of low deformation or stress as shown in FIGS. 26 and 27.

Furthermore, while in FIG. 1 the main-faces 110 and 120 are octagons, in some embodiments various other shapes can be used uniformly over element 100 or varying region by region or main-face by main-face. For example, the peaks and valleys may have more or less sides with varying or constant side-lengths.

Figure 6:
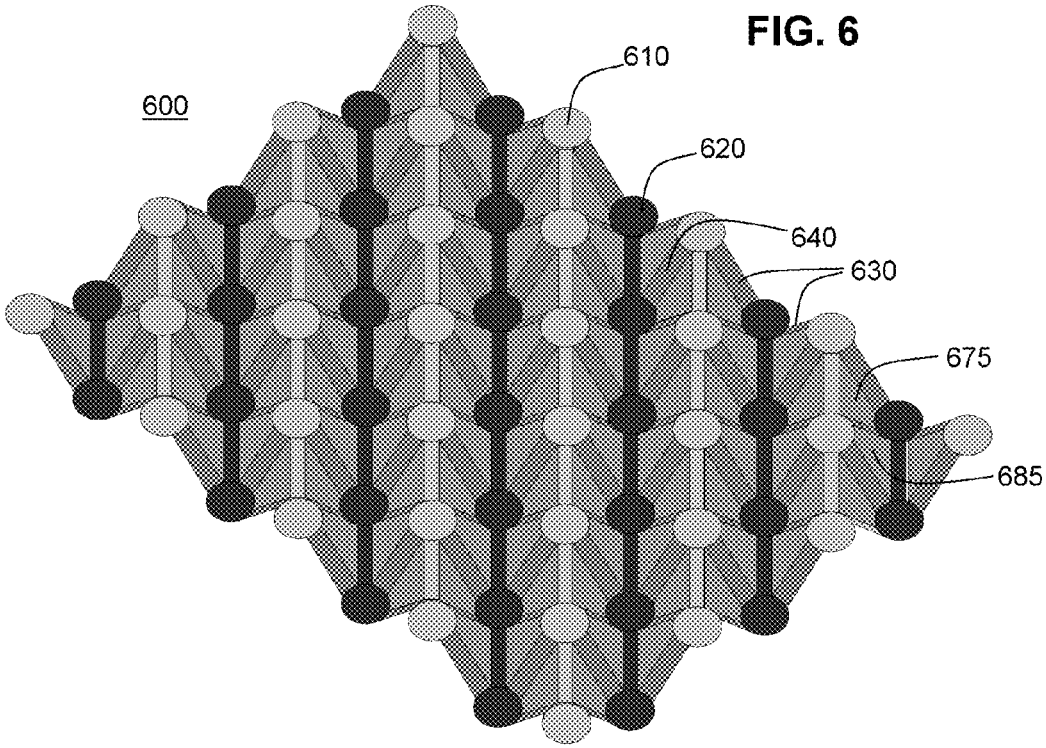
FIG. 6 is a projection view of an embodiment of a structural element with rounded main-faces.

As shown in FIG. 6, in some embodiments, main-faces 610 and 620 of a structural element 600 can be circular. Then, bridge-side-faces 675 and 685 can be curved and even change their curvature from one end, where they are attached to bridge-faces, towards the other end, where they are attached to circular main-faces 610, 620. Accordingly, side-faces 630 and 640 can also have curvature. Circular main-faces and accordingly curved side-faces and bridge-side faces can also increase stability against moments caused by deviations from the ideal truss.

Figure 7:
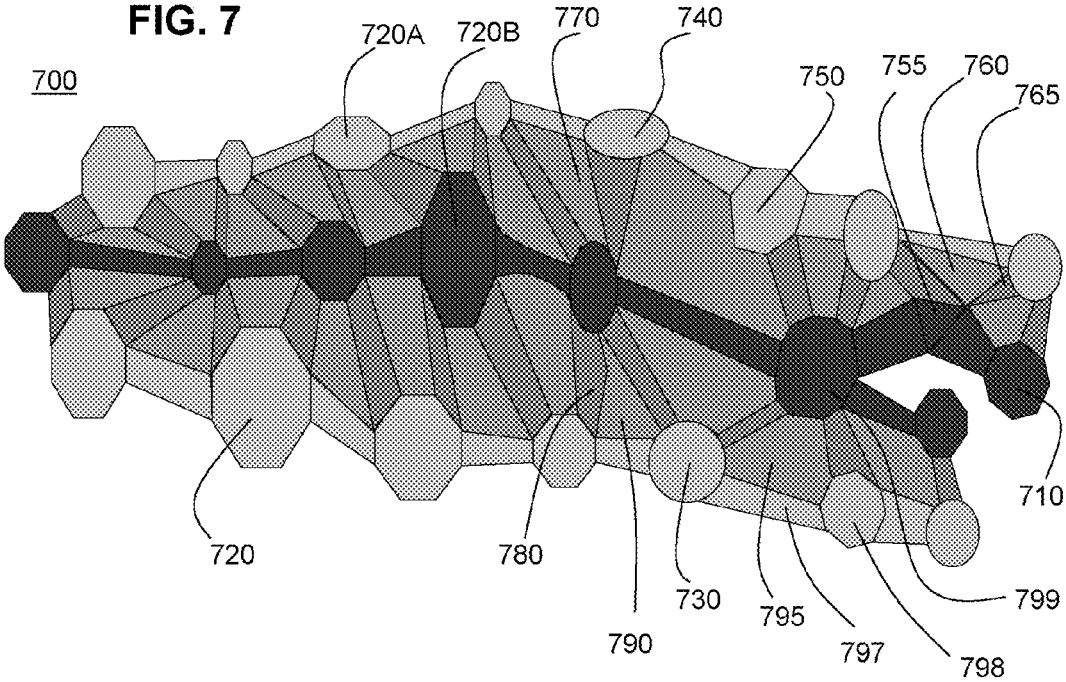
FIG. 7 is a projection view of a portion of an embodiment of a structural element illustrating different forms of faces.

In some embodiments of a structural element, the sizes and shapes of the main-faces and their orientations on the different sides of the element change independently from each other. FIG. 7 shows an example of a segment 700 of a structural element, which includes octagonal main-faces (symmetric 710 and elongated 720A, 720B), circular main-faces 730, elliptical main-faces 740, heptagonal main-face 750, triangular main-face 755 and higher order polygons such as hendecagon 799.

While the sides of successive main-faces 110 and 120 in FIG. 1 are parallel, this is not the case for some of the main-faces in FIG. 7. For example, main-face 720A and main-face 720B can be inclined with respect to each other. Moreover, while main-faces 110 and 120 in FIG. 1 are aligned in x- and y-directions, this is not the case in FIG. 7 in which the position of the main-faces varies within the x-y-plane and can in general also vary in the z-coordinate.

The side-faces in FIG. 7 are mostly four sided, even though also a three-sided side-face 765 is also shown. In general, different shapes and inclination angles of the side-faces and bridge-side-faces are possible and depend on the shape and relative position of the corresponding main-faces.

The bridge-side-faces shown in FIG. 7 are mostly trapezoidal and flat. However, in connection with a circular or elliptical main-face also curved surfaces are given (e.g., bridge-side-face 770). Also, there could be a triangular bridge-side-face 760. In addition, a specific form of a side-face may further determine the exact shape of a connected bridge-side-face (e.g., side-face 780 and neighboring bridge-side-face 790). Bridge-side-faces are not restricted to only be connected to the corresponding bridge-faces as shown in FIG. 1. For example, a bridge-side-face can also have more than four sides as shown for a bridge-side-face 795 that connects not only to corresponding bridge-face 797 but also at least partly to a main-face 798.

Figure 8A:
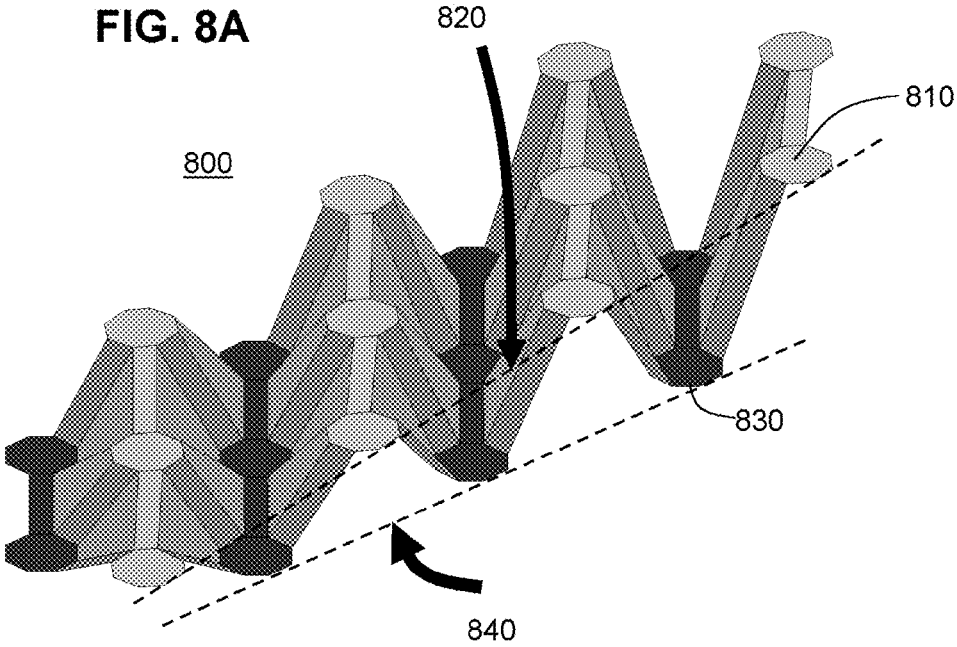
FIG. 8A is a projection view of an embodiment of a structural element having main-faces at an angle with respect to each other.
Figure 8B:
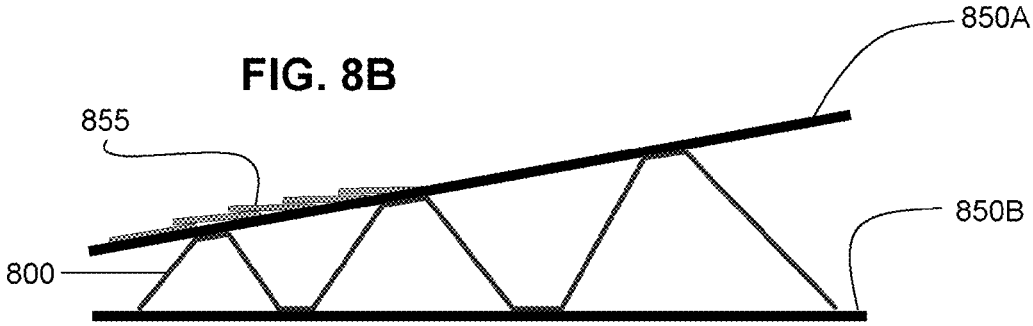
FIG. 8B is cross section of the embodiment of FIG. 8A including face-sheets.

While in FIG. 1 the first and second surface planes extend in the x-y-plane, generating a flat profile for parallel planar chord members, in some embodiments other orientations (e.g., inclinations and curvature) of the main-faces and, therefore, other orientations and/or shapes of the surfaces defined by the main-faces are possible. For example, FIGS. 8A and 8B illustrate an embodiment 800 in which main-faces 810 of surface 820 (defining the top side of element 800) are configured to increase in their distance to main-faces 830, which lay in a surface 840 (defining the bottom side of element 800).

Faces 810 (and therefore, also surface 820) are inclined with the same angle with respect to surface 840. In some applications, such an inclination angle also generates an angle between face-sheets 850A and 850B attached to element 800, as shown in FIG. 8B, providing a profile with a sloped planar top chord member. This configuration can be applied, for example, in roof construction of two with respect to each other inclined surfaces, where element 800 provides the required stability through forming truss-web configurations. Thus, face-sheets 850A can be used as ceiling and roof within a building, and shingles 855 could be placed on top.

To generate a step-like upper surface, element 800 can be modified such that main-faces 810 and 830 are parallel to each other while they increase in distance.

Figure 8C:
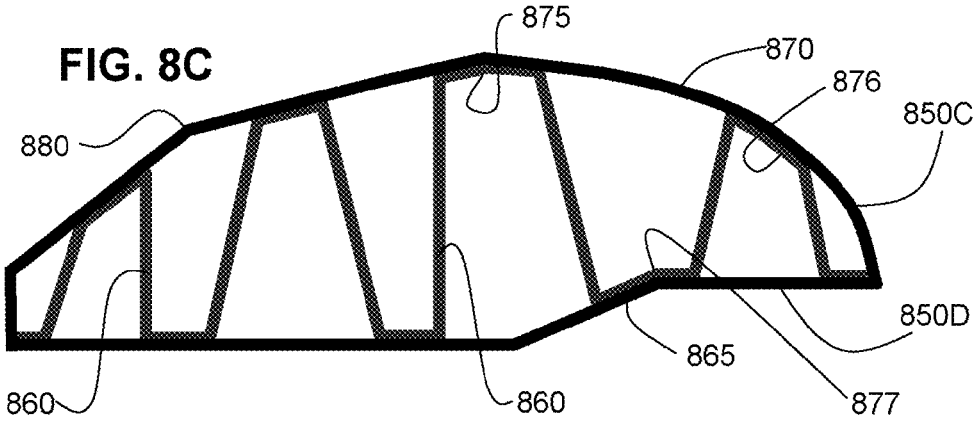
FIG. 8C is a cross section of an embodiment of a structural element with face-sheets illustrating different angles and shapes of the faces and face-sheets.

FIG. 8C shows different "profiles" of a trussing configuration as defined by the face-sheets acting as planar chord members. Specifically, face-sheets 850C and 850D acting as top and bottom chord members of the truss configuration, provide profiles of varying pitch 880 and 865, and even with arched shape 870. It is also shown how main-faces 875, 876, and 877 adapt in shape to the chords 850C and 850D of the trussing system.

Additionally, FIG. 8C shows side-faces 860 that are vertical with at least one of the face-sheets, which can be desirable for certain applications and truss-configurations. Vertical elements 860 that are possible partly because of the main face being an "octagon," thus, because of the bridges width $w_b$.

Figure 9:
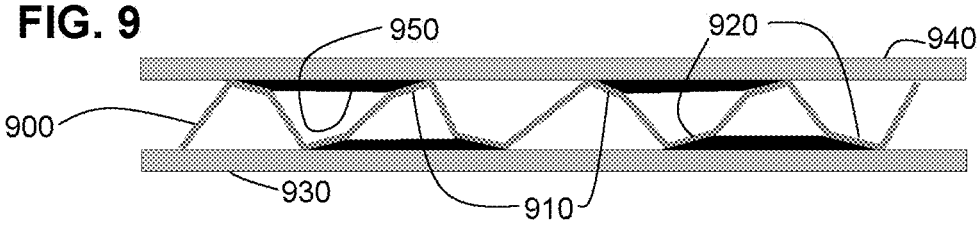
FIG. 9 is a cross section of an embodiment of a structural element in which main-faces are not in the same plane.

Another modification is shown in FIG. 9, which can be applied in various types of structural elements. In FIG. 9, successive main-faces 910 and 920 (on the same side of structrual element 900) are tilted with respect to each other to form recess-like structures. To be interlockable with the recess-like structure of structural element 900, face-sheets 930 and 940 are formed to provide a ridge 950. The angles created at the contact surface areas reduce the component of a horizontal force applied in the direction of those areas, resulting in lower shear stress in the bonding or other joining mechanism.

Figure 10:
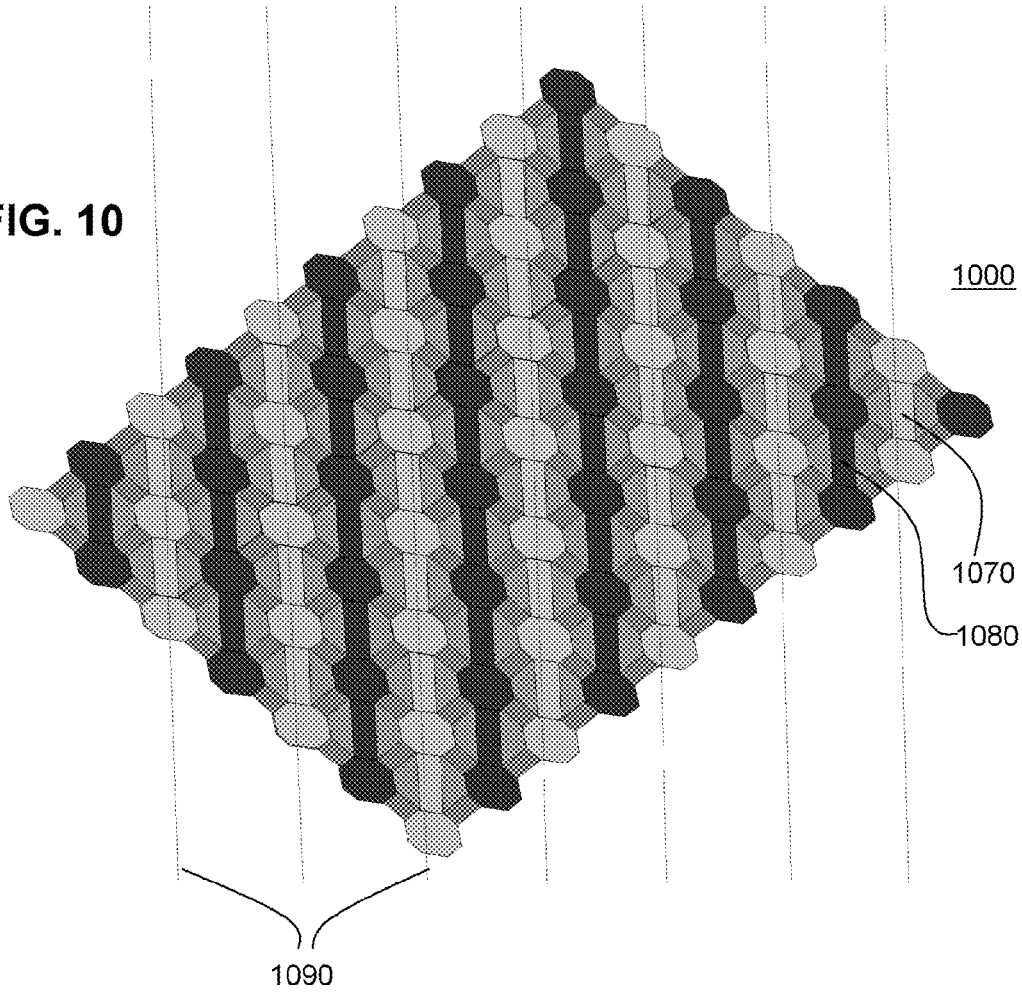
FIG. 10 is a view of an embodiment of a structural element illustrating bending axes.
Figure 11:
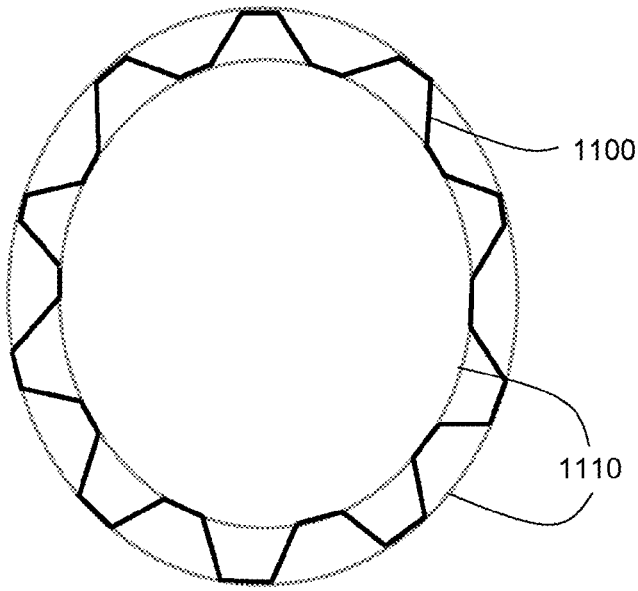
FIG. 11 is a cross section of an embodiment of a ring shaped structural element with inner and outer face-sheets.

While element 100 of FIG. 1 extends in a plane, specifically the x-y-plane, non-planar configurations of the structural element are also possible. For example, as illustrated in FIGS. 10 and 11, the linear alignment of bridge-faces 1070 and 1080 allows bending of an element 1000 around bending axes located along bridge-faces 1070, 1080. As an example, bending axis 1090 are shown for bridge-faces 1070. An application of curved structural elements is the reinforcement of curved structures. For example, a curved structural element 1100 can be used as a continuous core-component in a double-walled pipe with walls 1110 as shown in FIG. 11. Further applications include pressurized tanks (e.g. liquid, gas are water tanks), reinforced wall structures for airplanes, spacecrafts, ships, submarines and other vehicles.

Figure 12:
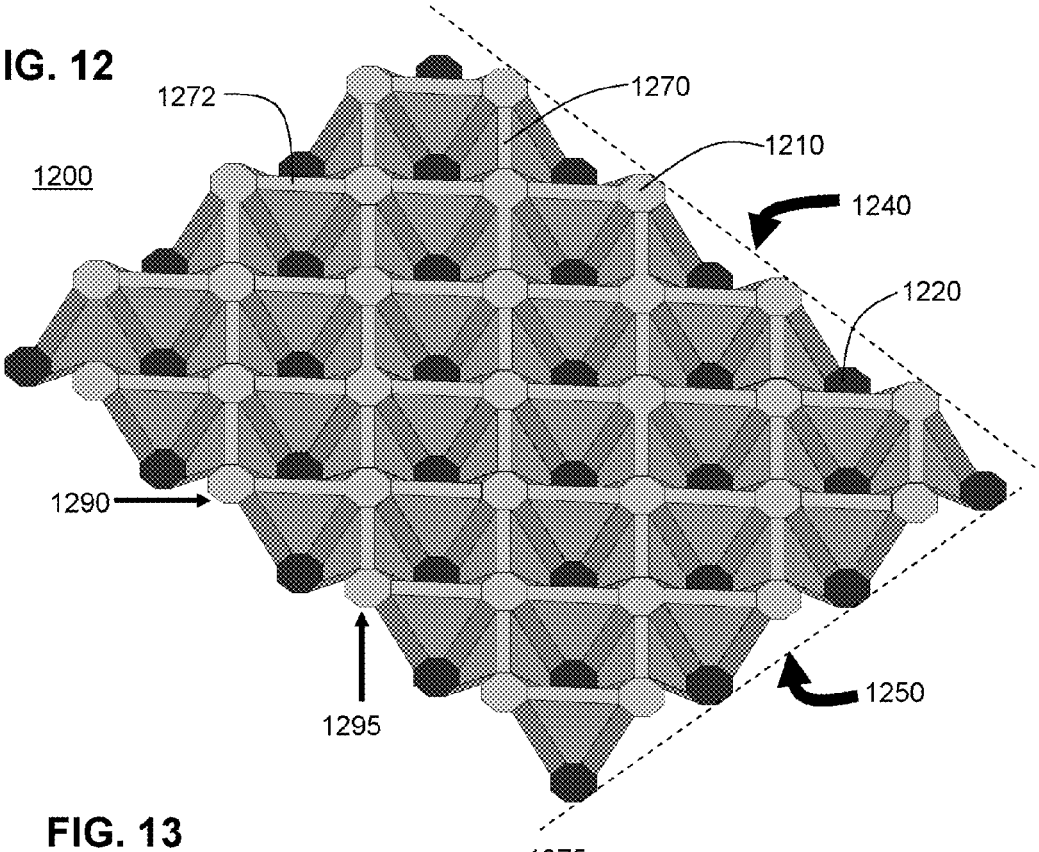
FIG. 12 is a projection view of an embodiment of a structural element with bridge-faces on one side of the structural element.

While in FIG. 1 bridge-faces 170 and 180 on both sides of element 100 are linearly aligned to one another, various other configurations to connect the main-faces via the bridge-faces are also possible. In general, the bridge-faces can be positioned to provide any structure of open-ended or closed-ended channels. For example, as shown in FIG. 12 for a section of an element 1200, bridge-faces 1270 connect main-faces 1210 on a first side 1240 of element 1200 under one angle and bridge-faces 1272 connect also main-faces 1210 (on side 1240) but under another angle. Main-faces 1220 on an opposite side 1250 of element 1200 are not connected. Thus, bridge-faces 1270 and 1275 connect only main-faces at she same side 1240 of element 1200, thereby forming a grid-like configuration of channels on the opposite side 1250 of element 1200. For example, channels 1290 and 1295 can be formed on side 1250 by attaching a face-sheet to main-faces 1220.

Figure 13:
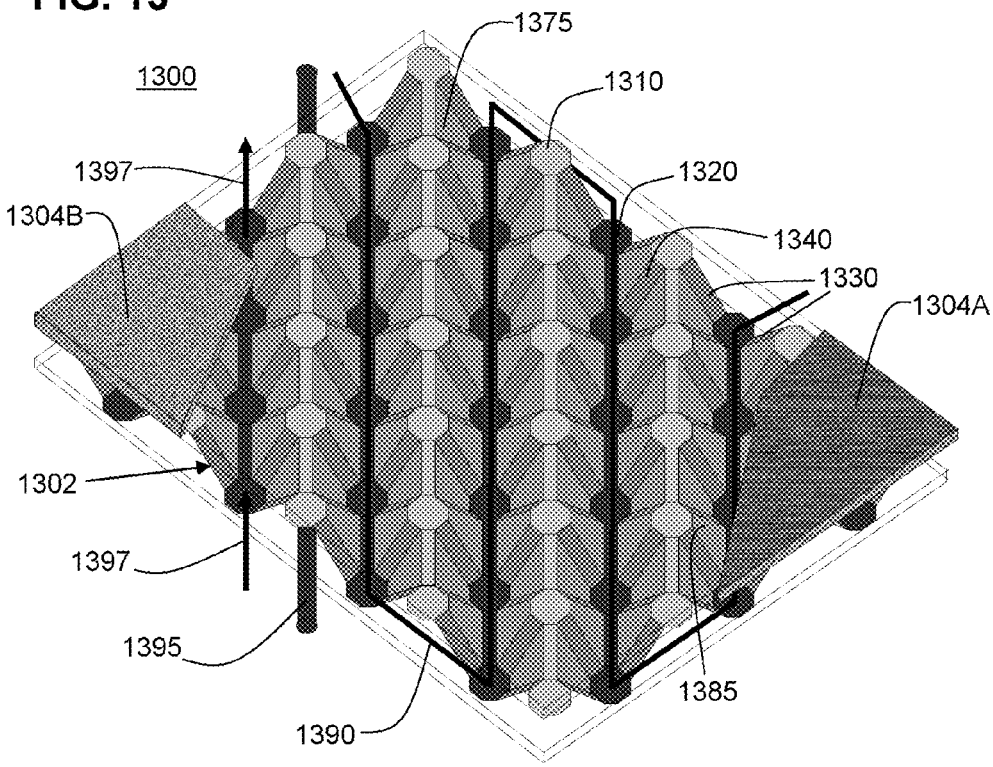
FIG. 13 is a projection view of an embodiment of a composite element.
Figure 14:
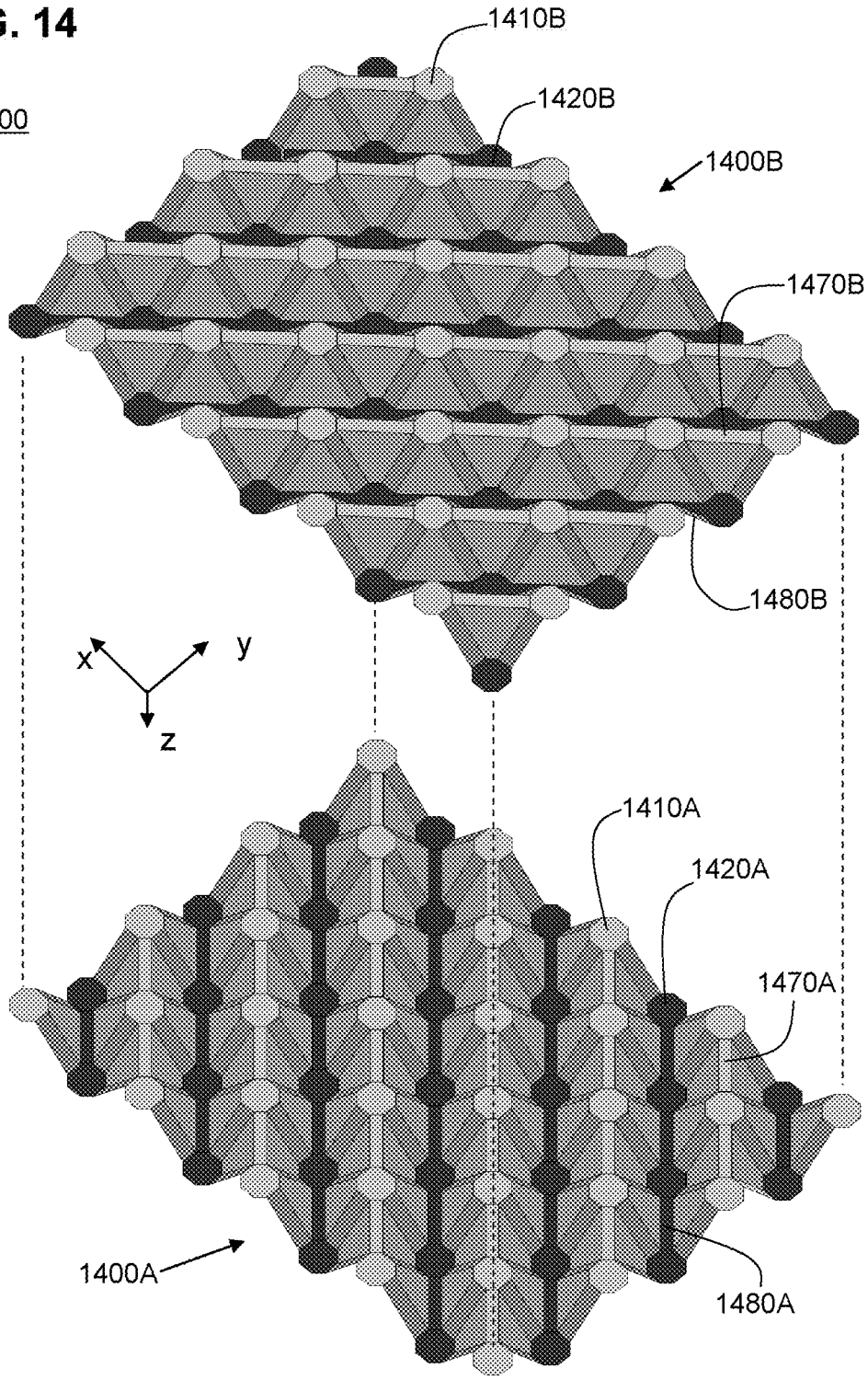
FIG. 14 is a projection view of an embodiment of double layer of two structural elements.
Figure 15:
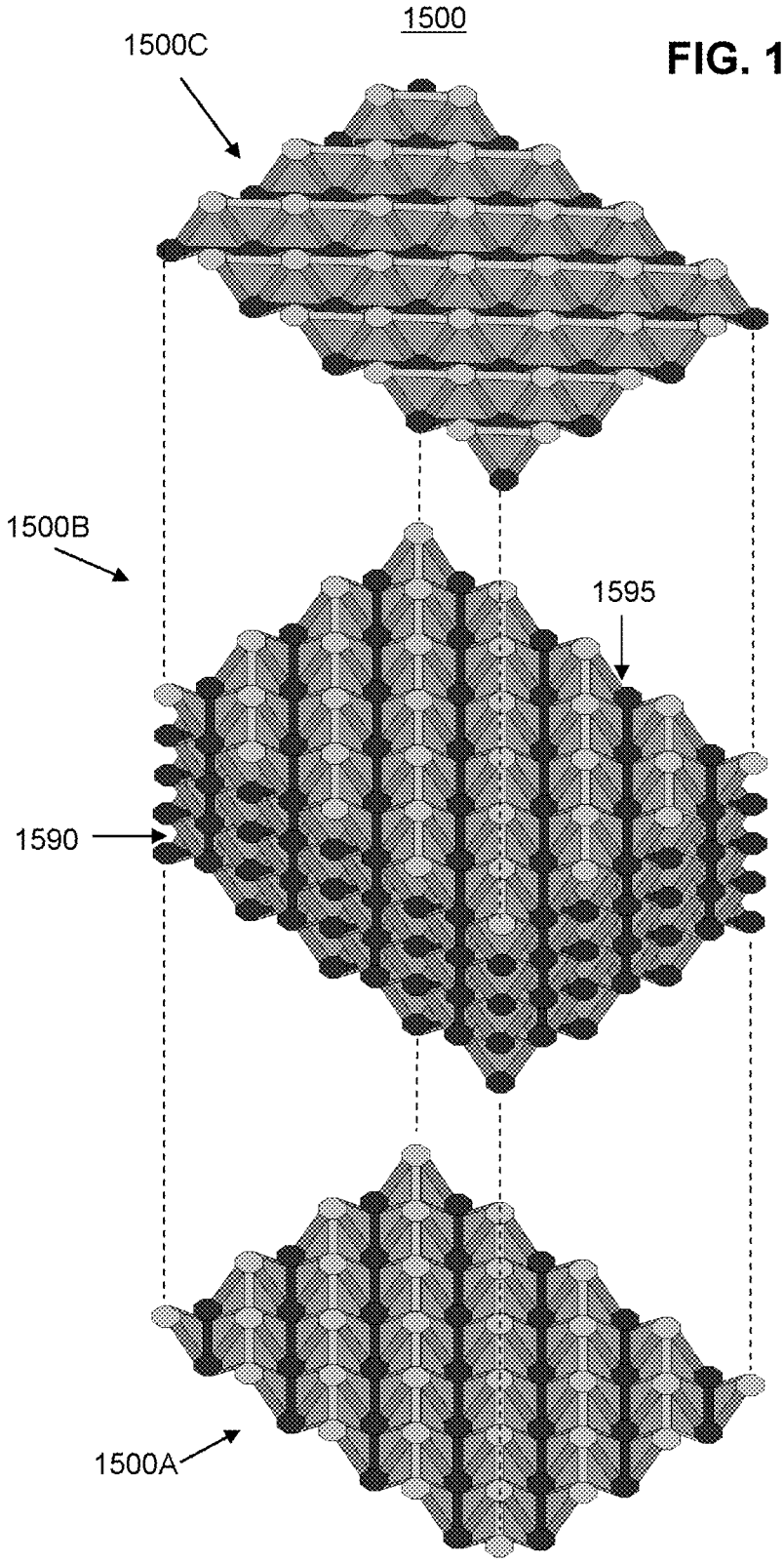
FIG. 15 is a projection view of an embodiment of double layer of an open lattice structure.

While above the continuous structural elements were described as a stand alone structure, configurations are described in connection with FIGS. 13-15 in which the element is used as a continuous core component of a sandwich structure as shown in FIG. 13 or as a component of an open lattice structure as shown in FIGS. 14 and 15.

FIG. 13 shows a sandwich structure 1300 based on a three-dimensional structural element 1302 as continuous core component. As face-sheets, a top plate 1304 and a bottom plate 1306 are attached to the upper and lower sides respectively, through a bonding or joining mechanism acting at main-faces 1310, 1320 and bridge-faces 1315, 1325. The sandwich structure is a lightweight structural panel. Main-faces 1310 and 1320, and bridge faces 1315, 1325 are node contact areas between the continuous core component and the face-sheets of the sandwich construction, and may increase or decrease in size, to allow for larger or smaller bonding or joining area.

Within sandwich structure 1300, element 1302 acts as a continuous core and provides truss-configurations in multiple directions as described, for example, in connection with FIG. 1. When a load is applied, for example, perpendicular to the face-sheet 1304, the diagonal running faces (side-faces and bridge-side-faces), transfer the load from face-sheet 1304 to face-sheet 1306, acting the continuous core component as a multidirectional web of multiple truss configurations.

In some embodiments of structural element 1302, the transitions where the different faces meet may be rounded to reduce stress concentration at those places where there is change in direction, as foregoing discussed in connection with FIG. 3B.

The core component and the face-sheets of the sandwich structure can be joined through different kinds of mechanical fasteners, chemically, by thermal and sonic means, or by any other manner suitable to the materials employed.

FIG. 13 also shows the possible use of the panel with an embedded piping system 1390. If the top face-sheet is transparent and the structural element is reflective, the angles of side-faces and bridge-side-faces could be designed to concentrate radiation and heat in piping system 1390, such as in a solar heat collector. Used as a solar collector panel, the top face-sheet may be transparent in one direction and reflective in the other, not letting the solar heat and radiation leave sandwich structure 1300. IN some embodiments, channels 1397 of sandwich structure 1300 can be used as passageways of fluids or gases.

While in FIG. 13 the structural element is bonded to, e.g., planar face-sheets 1304, 1306, in some embodiments, several structural elements can be combined together. The structural elements can be of identical or similar structures thereby forming a three-dimensional open lattice structure. Within the open lattice structure, the stacked structural elements can be oriented with respect to each other as allowed by the specific geometry of the structural elements.

A configuration of an example of a stacked structure 1400 is shown in FIG. 14. Stacked structure 1400 includes two structural elements 1400A and 1400B, which are rotated by 90° around the z-axis with respect to each other. Main-faces 1410A of element 1400A are fixedly connected to main-faces 1420B of element 1400B. Moreover, bridge-faces 1470A that connect main-faces 1410A and bridge-faces 1480B that connect main-faces 1420B run with an angle of 90° with respect to each other, thereby providing additional rigidity to stacked structure 1400.

In the sandwich structure 1400 of FIG. 14, main-faces 1410A and 1420B act as node contact areas between the elements of the open lattice structure. The contact areas can be adapted in size, to allow for larger or smaller bonding surfaces. The elements of the open lattice structure may be joined in any manner suitable to the material employed therein.

While in FIG. 14, two elements 1400A and 1400B are connected, a sequence of several elements can be stacked in the same way to fit the requirements of a specific application. For example, FIG. 15 shows a structure 1500 of eight structural elements 1500B already stacked together, where a bottom element 1500A and a top element 1500C are aligned for attaching. As in FIG. 14, neighboring elements are rotated by 90° with respect to each other thereby providing a system of connected channels in structure 1500.

Structure 1500 is an example of an open lattice structure based on multiple structural elements. Open lattice structures can be achieved by stacking and joining various structural elements with or without providing face sheets between two elements. Open lattice structures form a tridimensional rigid body. In some embodiments, open lattice structures may replicate the properties of a low density solid, and as such, may be formed, cut or otherwise utilized for many different applications. In some embodiments, a deformable open lattice structure can be generated by using structural elements that are made from elastic materials such as rubber or others that are deformable due to a small thickness d of the material of the structural elements.

Moreover, in some embodiments, multi-layer open lattice structures can be based on structural elements made of different materials that are assembled and joined together. Thereby, one can meet requirements specific for applications. Example materials include various types of metals, rubber, plastic, advanced composite materials (ACMs) or fiber reinforced polymers (FRFs). In some embodiments, an open lattice structure can include structural elements that provide shock absorbing features, insulating features (thermal, electrical, acoustical). In some embodiments, a relative orientation of the bridge faces of neighboring structural elements provides a system of unconnected channels that can be used for the guiding gases or liquids. Applications include the heating or chilling or heating of fluids or gases passing through the channels.

In some embodiments, open lattice structures provide an internal surface that can be used, for example, for heat exchange or chemical reactions supported by catalytic properties of the material of the structural elements. Furthermore, when structural elements of one material acting as anodes are assembled with structural elements of other materials acting as cathodes, separated by some kind of dielectric material in their areas of contact (main-faces and bridge-faces), the channels can be filled with an electrolyte forming a battery cell. The increased surface area as compared with a flat surface may prove useful for this application.

Examples of channels are indicated in FIG. 15 by reference numerals 1590 and 1595. In some embodiments, the channel structure is formed to provide recess structures at the border of two open lattice structures that can be used to interconnect the two with each other. An example is discussed below in connection with FIG. 19A.

In general, face-sheets as shown in FIG. 13 can be added in between layers of the open lattice structure.

As an example of a large scale application, applications of structural elements for conventional building (FIGS. 16A to 18B) and, in particular, for a modular building system of a house (FIGS. 19 to 23) are explained in more detail. The concept can easily be scaled to smaller size application to provide, for example, a small scale modular building system of, e.g., small housings for various interior such as, e.g., electrical devices.

Figures 16A, 16B, 16C, 17A, 17B, 17C:
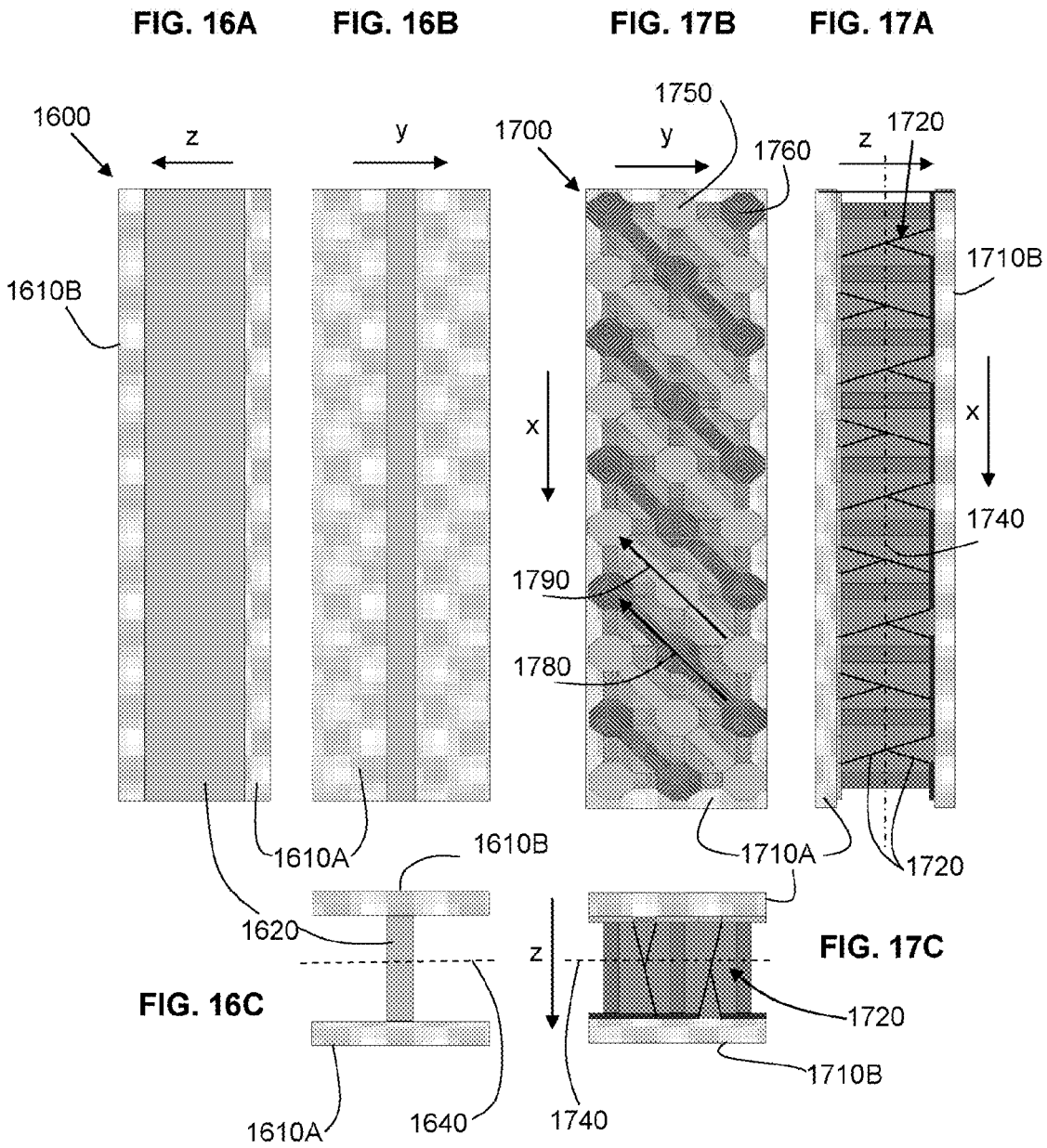
FIG. 16A is a side view of an I-beam.
FIG. 16B is a view of a first cross section of the I-beam of FIG. 16A.
FIG. 16C is a view of a second cross section of the I-beam of FIG. 16A.
FIG. 17A is a side view of a beam with a structural element.
FIG. 17B is a view of a first cross section of the beam of FIG. 17A.
FIG. 17C is a view of a second cross section of the beam of FIG. 17A.

FIGS. 16A to 16C show three views of a conventional I-beam 1600. FIG. 16A shows a side view of the two flanges 1610A and 1610B connected by the web 1620. FIG. 16B shows a top view of I-beam 1600 with top flange 1610B removed. FIG. 16C shows a view of I-beam 1600 in x-direction. Web 1620 separates flanges 1610 from a neutral axis 1630 of I-beam 1600, thereby increasing the stiffness in a direction along web 1610, i.e., in z-direction.

In some embodiments, a beam 1700 can be build with a structural element 1720 between two flanges 1710A and 1710B similar to the I-beam of FIGS. 16A to 16C. FIGS. 17A to 17C show three views of beam 1700 similar to FIGS. 16A to 16C for conventional I-beam 1600. Structural element 1720 separates flanges 1710A and 1710B from a neutral axis 1740 of beam 1700. Main-faces 1750 connect to flange 1710A, main-faces 1760 connect to flange 1710B, and bridge-faces 1770 are aligned under an angle of 45° with respect to the x-axis and y-axis. Accordingly, also channels 1780 and 1790 run under an angle of 45° with respect to the x-axis and the y-axis. FIG. 17C showing a view of beam 1700 in x-direction, illustrates the embedded trusses-configurations.

Thus, instead of web 1620 in FIG. 16, structural element 1720 transfers load from one flange to the other through a truss-web in multiple directions that is provided by the structural element. These truss-configurations add additional stiffness to beam 1700 not only in y-direction through the truss-configuration shown in FIG. 17C, but also, for example, in x-direction and across the bridge-faces.

Figure 18A:
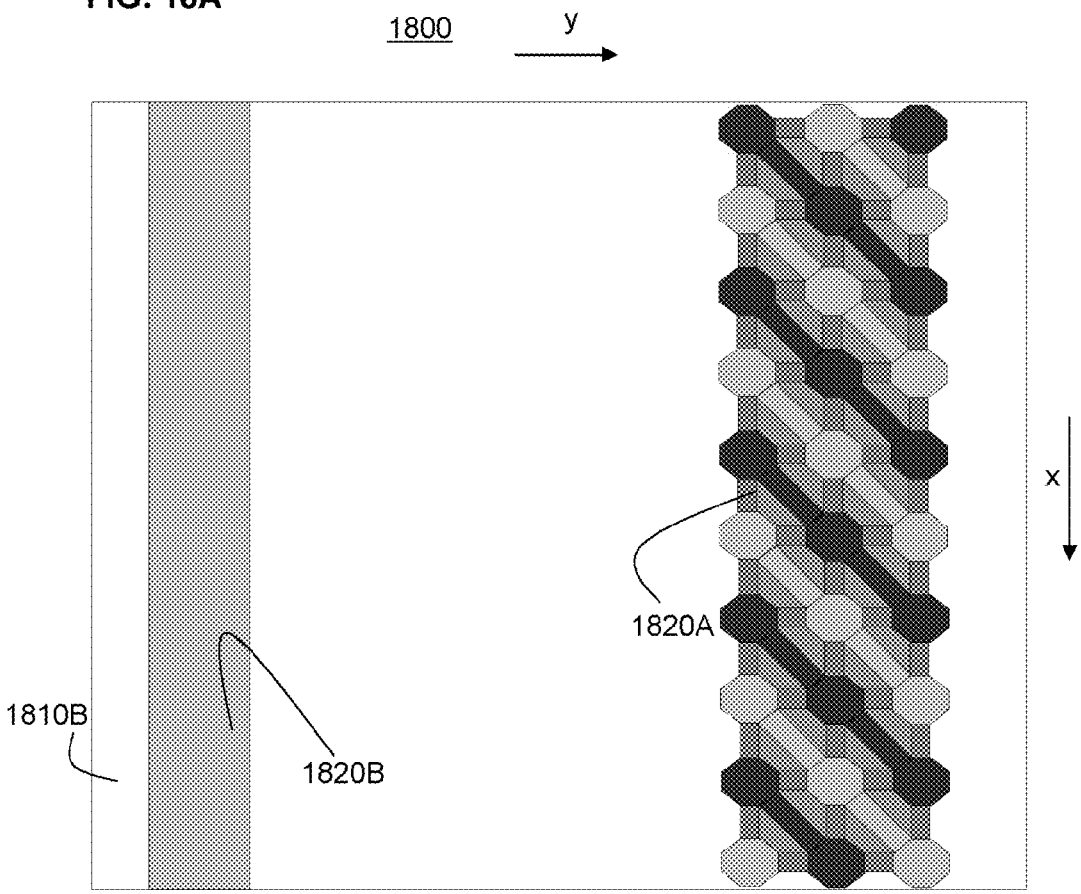
FIG. 18A is a view of a first cross section of a sandwich structure comparing a stud configuration and a structural element configuration.
Figure 18B:
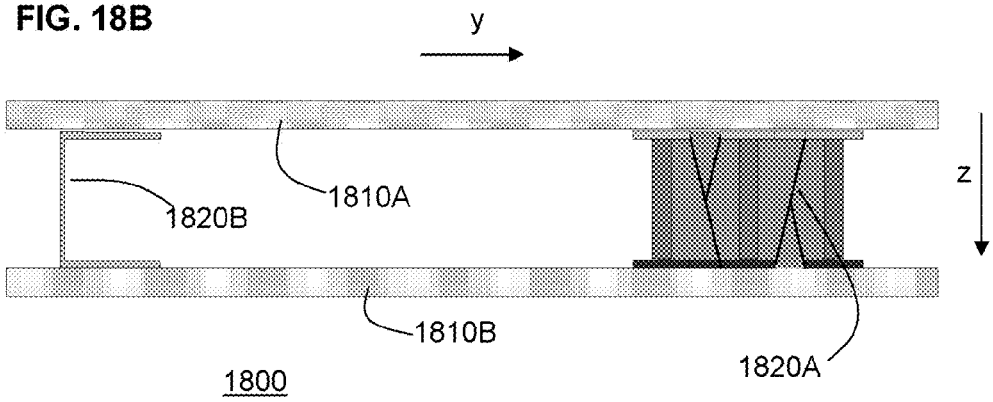
FIG. 18B is a view of a second cross section of the sandwich structure of FIG. 18A.

In some embodiments, a building system for houses is based on transportable wall units including stackable structural elements, face-sheets (e.g., drywall, fiber reinforce polymers, cement based or wood boards), and connectors. In some embodiments of the building system, one or more strips of structural elements replace wall studs as vertical members in a frame construction 1800. As an example, FIGS. 18A and 18B show a top view and a side view of a wall element 1800, where a pair of drywalls 1810A and 1810B (top drywall 1810A is removed in FIG. 18A for clarity), are hold together by one or more localized strips 1820A made of one or more structural elements that replace common studs 1820B. FIG. 18B shows a side view in x-direction of stud 1820B and structural element 1820A, making clear their differences in geometry.

Based on the symmetric configuration of the structural elements, stacking the structural elements (without leaving any open space as with studs or similar alternatives) can simplify the transport and thereby decrease transportation costs.

Figure 19:
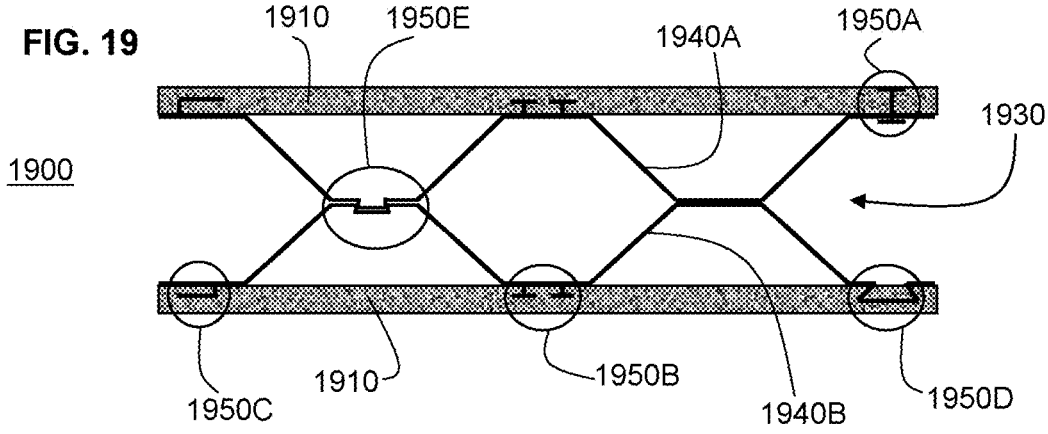
FIG. 19 is a view of a cross section of two structural elements between two face-sheets.

As another example, FIG. 19 is a schematic showing some ways to join face-sheets and structural elements and structural elements between themselves. These joining mechanisms can be used, for example, in an embodiment substituting the traditional concrete-block. Specifically, structural elements 1940A and 1940B forming a double layer 1930 are joined together and attached through several joining mechanisms to concrete face-sheets 1910. These joining mechanisms may include, for example, rivets 1950A, bolts 1950B, hooks 1950C, and pockets 1950D.structural element. Hooks 1950C and pockets 1950D can either be formed as integral part of the structural layer or they can be attached (e.g., screwed, glued) to the main-faces. In a similar manner, also structural elements 1940A and 1940B of double layer 1930 can be attached to each other as shown for interlocked pockets 1950E.

The structural elements as applied herein in, for example, FIGS. 18, 19, 20 and 22 provide multidirectional trusses to transfer a load (e.g., lateral wind and seismic forces) from one wall face to the other. If the faces are made out of very high tensile strength materials, when the load is applied onto a first face, it will be immediately transmitted to the second face via the truss-web configurations of the structural element. The first face deformation will be limited due to the resistance to tensile deformation that the second face will show.

Figure 20A:
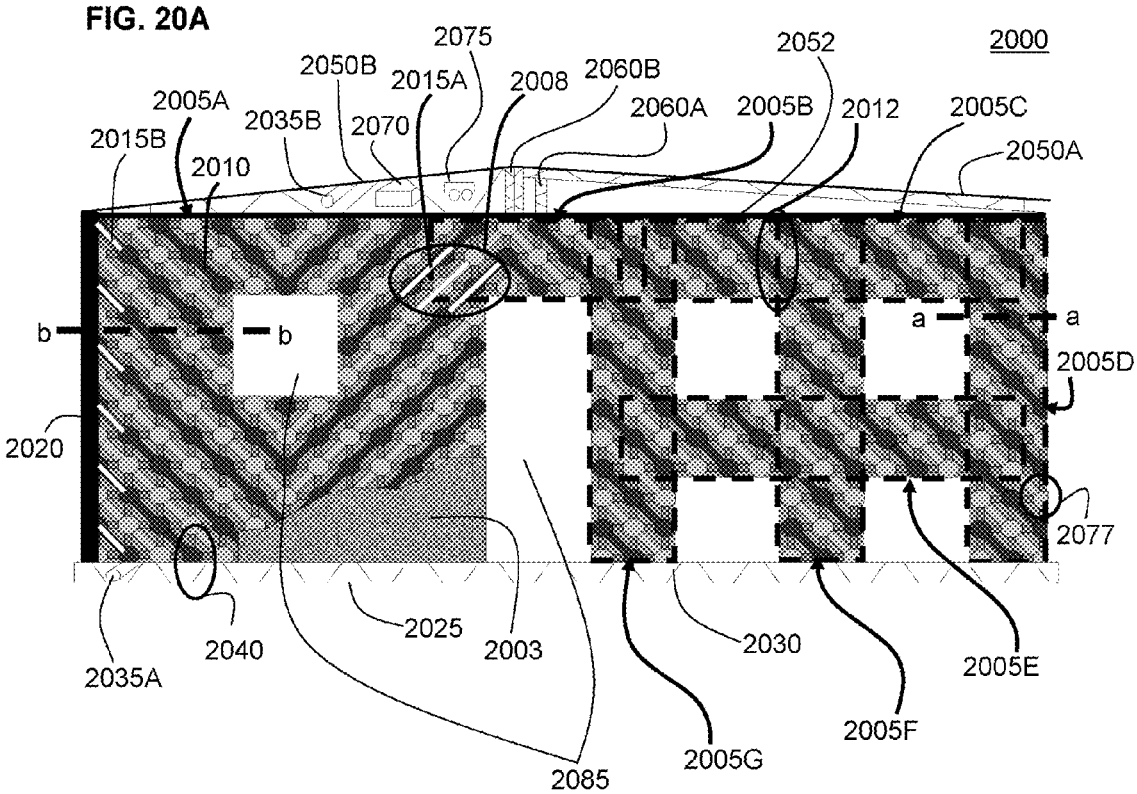
FIG. 20A is a front view of a housing application based on structural elements.

FIG. 20A shows schematically a front-view of a house 2000 to illustrate various embodiments in which structural elements can be used in a modular building system. Several ways to join structural elements an related sandwich-type structures are described below in connections FIGS. 21A-21F.

A continuous core component of a wall of house 2000 is made from structural elements 2005A to 2006G of structural element interlocked together. The structural elements 2005A to 2006G can be a single layer or a multilayer structure, and can be planar or strip-like shaped as discussed herein. Exterior and interior face-sheets 2003 made of various types of materials can be attached to the sides of continuous core component.

Figure 24:
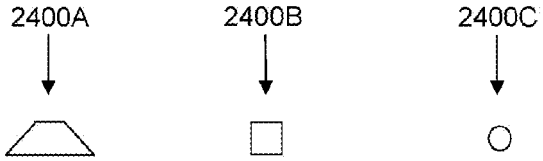
FIG. 24A is a view of a cross section of a first stabilizing member.
FIG. 24B is a view of a cross section of a second stabilizing member.
FIG. 24C is a view of a cross section of a third stabilizing member.

As shown in region 2008 within the wall, bridge-faces 2010 of structural elements 2005A and 2005B are aligned such that structural elements 2005A and 2005B can be connected via pins 2015A that reach in opposing channels, with cross sections such as the ones shown, for example, in FIG. 24. Another joining mechanism is shown for region 2012 of the wall in FIG. 20D. Specifically, structural elements 2005B and 2005C can be positioned on top of each other and if necessary be fixed joined together with, e.g., screws, bolts or rivets 2014 as shown in FIG. 20D.

Figure 20B:
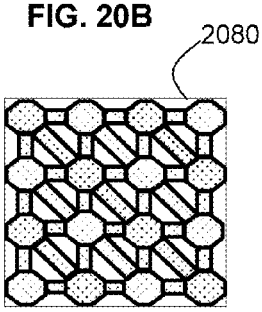
FIG. 20B is a view of a window based on a transparent structural element.
Figure 20C:
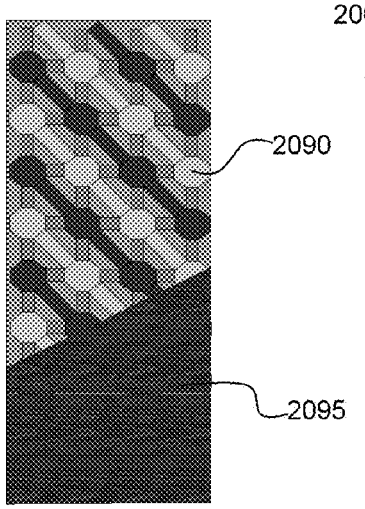
FIG. 20C is a view of a door based on a composite element.
Figure 20D:
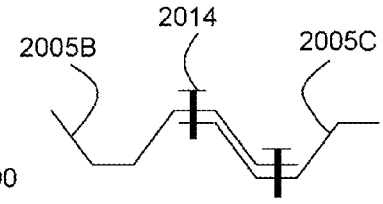
FIG. 20D is an illustration of a connecting mechanism of adjacent structural elements.

While structural element 2005A extends over the complete wall, the core component on the right hand side of the house is composed of strips of structural elements 2005C-2005G that are over-imposed and joined together in the manner shown in FIG. 20D. A cross-section through structural element 2005D along lines a-a in FIG. 20A can correspond, for example, to the right section of the configuration shown in FIG. 18B. Alternatively, a pre-cut portion of structural element could provide also the shape shown therein.

Figure 21A:
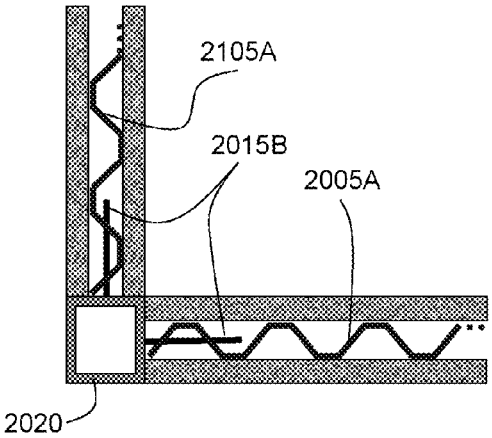
FIG. 21A is a view of a cross section of a column connecting to composite elements.

In FIG. 21A, an example of joining two structural elements of contiguous sandwich structures at an angle is shown. A corner post 2020, also shown in FIG. 20A, provides pins 2015B that reach into channels of structural elements 2005A and 2105A. Post 2020 itself is attached to a floor system 2025 of house 2000, holding down both structural elements 2005A and 2105A and anchoring them to the foundation, acting as an anchoring column.

Figure 21B:
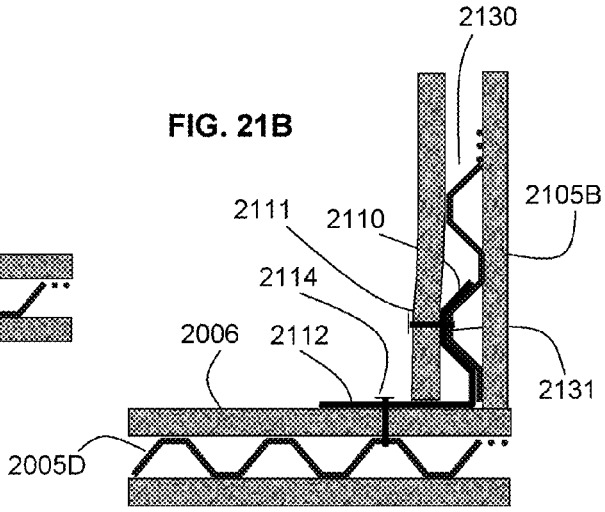
FIG. 21B is a view of a cross section of a first connecting element connecting to composite elements.

Another example of joining two sandwich-type walls is illustrated in FIG. 21B, which shows the connection of a structural element 2130 of the side wall of house 2000 to the face-sheet 2006 attached to structural element 2005D of the front wall by an angled structural element 2110. Angled structural element 2110 fits geometrically to both the face-sheet 2006 of structural element 2005D of the front wall of the house 2000 and structural element 2130 of the side wall, i.e., main-faces 2111 of angled structural element 2110 attach to main-faces 2131 of structural element 2130 and a flat-face 2112 of angled structural element 2110 attach to face-sheet 2006 of front wall.

Figure 21C:
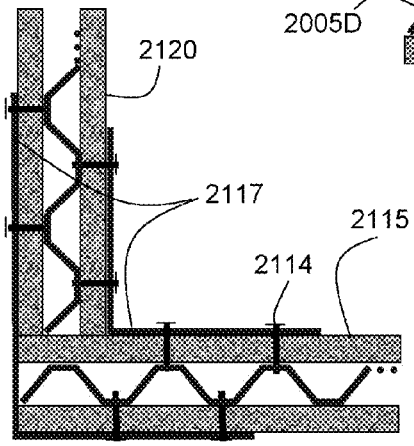
FIG. 21C is a view of a cross section of a second connecting element connecting to composite elements.

Another example of joining two sandwich-type walls is illustrated in FIG. 21C, which shows the connection of wall 2115 with wall 2120 through angled flat corner elements 2117. Corner elements 2117 are attached to each wall through some kind of a mechanical fastener 2114, e.g. bolts or rivets.

Figure 21D:
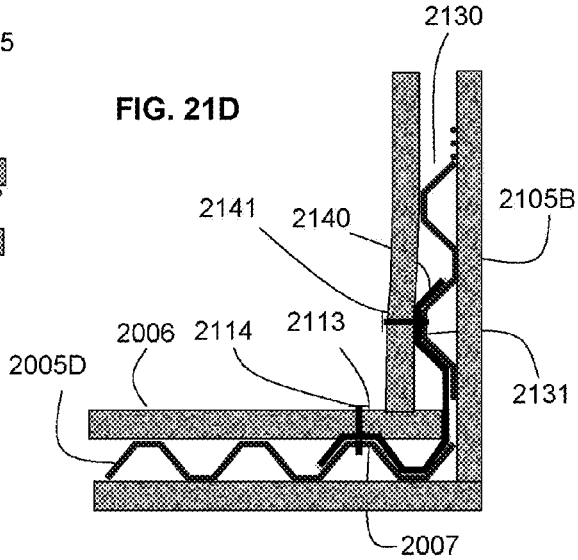
FIG. 21D is a view of a cross section of a third connecting element connecting to composite elements.

One more example of angled connection is shown in FIG. 21D, which shows the connection of a structural element 2130 of the side wall of house 2000 to structural element 2005D of the front wall by an angled structural element 2140. Angled structural element 2140 fits geometrically to both structural element 2005D of the front wall of the house 2000 and structural element 2130 of the side wall, i.e., main-faces 2111 of angled structural element 2140 attach to main-faces 2131 of structural element 2130 and main-faces 2113 of angled structural element 2140 attach to main-faces 2007 of the front wall.

Figure 21E:
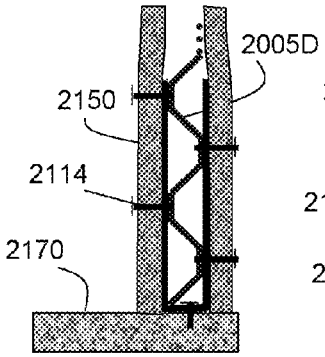
FIG. 21E is a view of a cross section of a fourth connecting element connecting a composite element to a floor system.
Figure 21F:
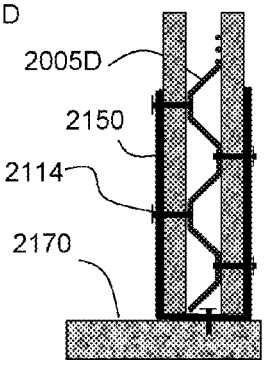
FIG. 21F is a view of a cross section of a fifth connecting element connecting a composite element to a floor system.

Another example of connection is shown in FIG. 21E, where a U-shaped element 2150 is attached to face-sheets of core structural element 2005D and to a flat surface such as a floor slab 2170. For convenience, U-shaped element 2150 could be also attached on the outside to face-sheets 2006 of the sandwich embodiment of the front wall of house 2000 as shown in FIG. 21F.

In FIGS. 21A to 21F screw connections are indicated. However, various types of attaching the structural elements can be applied some of which were discussed in connection with FIG. 19.

While in FIGS. 21A to 21F the structural elements are connected under an angle of 90°, in some embodiments, connections under other angles are also possible. Then, for example, the angled structural element is bent accordingly. An example of a connection under an angle large than 90° is the connection between a roof segment 1950A and a wall of house 1900.

While in FIGS. 21A to 21D two structural elements are connected, in some embodiments, three or more structural elements can be connected using accordingly formed connections (angled structural elements, angled flat surfaces, or channels connector pints) and bonding mechanism such as bolts, screws, rivets, adhesives, among many others.

While in FIGS. 21A through 21D a wall is connected to another wall also one wall can be connected to a floor system 2025, 2170, using connecting elements similar to connecting element 2110, 2117, and 2140. Similarly, while in FIGS. 21E and 21F a wall is connected to a floor system 2025 or 2170, using connecting elements similar to 2150, a wall can be connected to another wall or even a wall made out of other materials such as, e.g., concrete.

Figure 22:
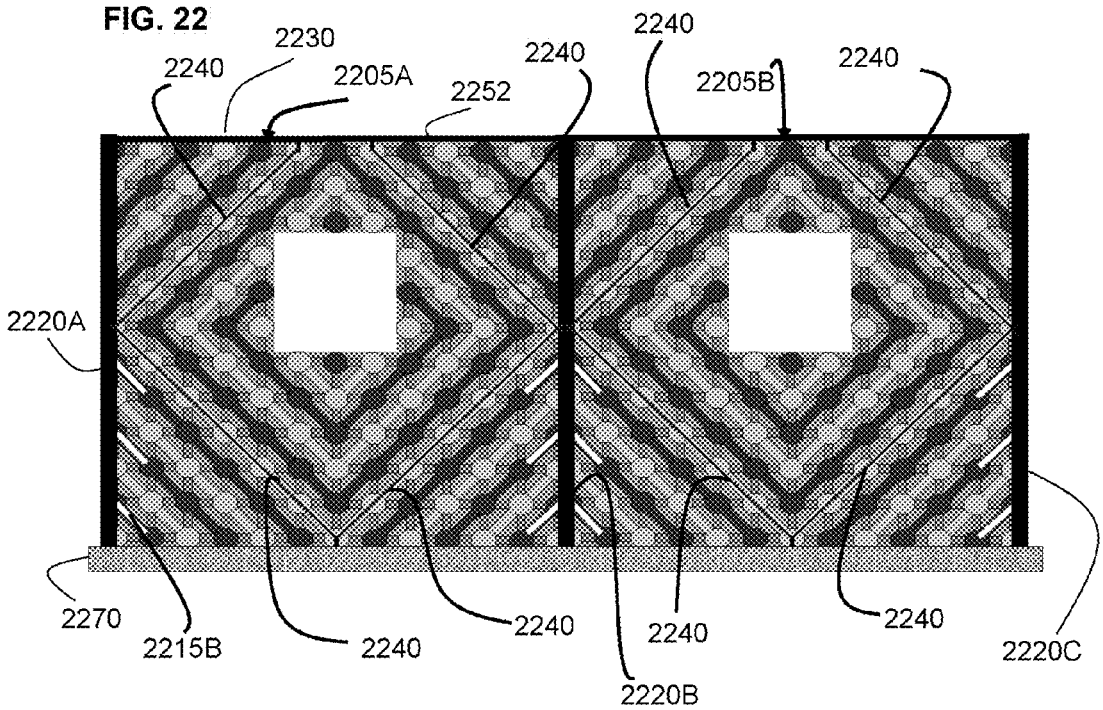
FIG. 22 is a front view a wall element based on two structural elements with passageways in different directions.

FIG. 22 illustrates another concept of mounting a wall comprising structural elements 2205, which can be applied in addition or alternatively to some of the foregoing discussed concepts. Posts 2220A, 2220B, and 2220C mount the structural elements 2205 vertically (e.g., using one or more pins and/or a guiding rail). An upper part 2230 is positioned on top of structural elements 2205 and fixedly connected to center post 2200B and side posts 2220A and 2220C. To provide lateral bracing, cable connectors 2240 are fed through channels provided by the structural element 2205. Upper part 2230 can be, for example, shaped as U-rail. Alternatively, cable connectors 2240 can attach to a roof or a slab at the upper end or to the floor at the lower end. The concept of using channels to provide stabilizing connectors can be applied alternatively or additionally to the foregoing described joining mechanisms. Moreover, posts such as 2220A can be used in an horizontal position as well.

Figure 23:
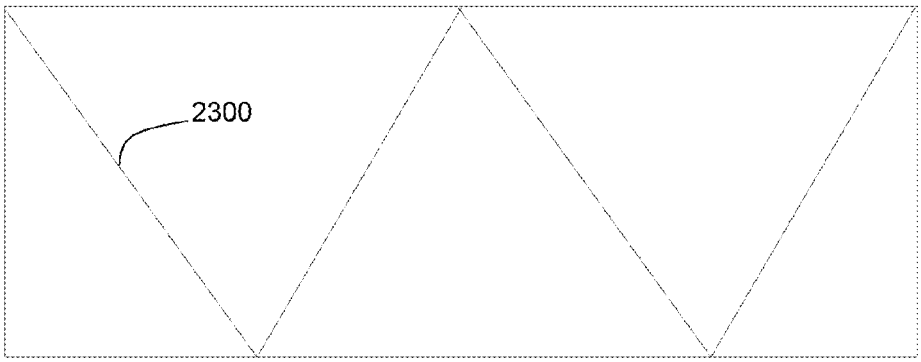
FIG. 23 is a schematic drawing illustrating a reinforcing element for stabilizing a wall element.

In general, the channels provided by a structural element can be configured to provide truss-configurations through the bridge-faces that make contact with the face-sheets, for example, within a wall. An example of such a configuration is shown in FIG. 23. Channels 2300 are formed using the structural element, specifically, by aligning the bridge faces of the structural element accordingly. Solid stabilizing members inserted in the channels can be attached to the floor and, e.g., a slab, thereby setting up a truss within the wall. Also, as channels 2300 show the alignment of bridge-faces in the configuration, and because these bridge-faces, along with the main-faces, connect the structural element to the face-sheets, another truss-configuration is developed in the connection of both elements as well, when used, for example a glue to join the stabilizing elements.

Referring again to FIG. 20A, floor system 2025 can include a layer of a continuous core component 2030. Channels formed by continuous core component 2030 can be used, e.g., for a multi-purpose piping system. Pipes 2035A in the channels can be water pipes (e.g., of a floor heating system) or they can be used for guiding cables or airflow. In addition, the channel system can be filled with material for thermal and acoustical insulation. Similarly, pipes 2035B can be run within a channel system of a roof segment 2050B to be used, e.g., for solar energy collecting purposes when the top facesheet is transparent as discussed in connection with FIG. 13, or within the walls.

FIG. 20A illustrates further that roof segment 2050A is based on two parallel face-sheets connected by a structural element as shown, for example, in FIG. 1, while roof segment 1950B illustrates a structural element with two tilted face-sheets, connected by a structural element as shown, for example, in FIG. 8B. FIG. 20A shows further a single-layer of structural elements 2060A with two face-sheets attached to the sides acting as a beam for roof segment 2050A and a double-layer structural elements 2060B with face-sheets attached to the sides and an additional central face-sheet acting as a beam for roof segment 2050B.

While in FIG. 20A, floor system 2025 is shown as a slab-on-grade foundation, floor system 2025 can also be a slab between two levels of a multi-level building. Alternative configurations of the slabs or walls of the house make use of the structural element as a reinforcing member.

Figure 25A:
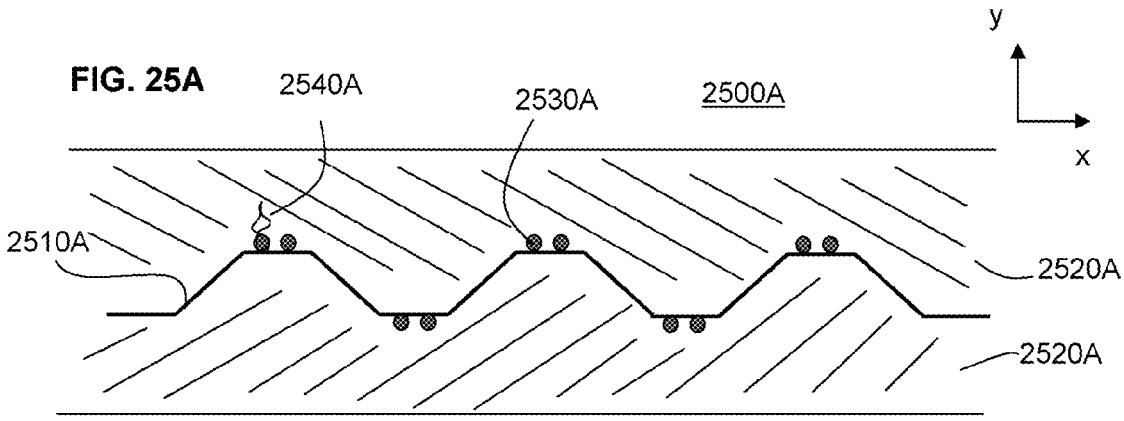
FIG. 25A is a view of a cross section of a structural element embedded in concrete.

An example of a reinforced wall member is described in connection with FIGS. 25A, 26, and 27. A structural element 2510A of a wall member 2500A is attached to steel rebar 2530A with a tie-up wire 2540A. Steel rebar 2530A runs perpendicular to the plane and is embedded in concrete 2520A to provide additional structural strength. The structural element may not be a continuous surface but rather a surface with some open spaces to allow for the concrete to flow through as shown, for example, in FIG. 26. Open spaces may also be useful in other applications, resulting in less material usage. In this embodiment, the structural element helps locate the steel rebar apart from the neutral plane perpendicular to x-y plane, and together, create truss-like elements in that direction.

In particular, FIG. 26 shows an embodiment of a structural element 2610 with open spaces 2670 and steel rebar in different configurations, in y-direction steel rebar 2630, 2660 and in diagonal direction steel rebar 2650, crossing through the bridge-side-faces of the structural element. FIG. 26 shows further tie-up wire 2540A and a hook 2690 as some mechanism to attach the steel rebar to the structural element 2610.

FIG. 27 shows another embodiment of structural element 2710 with open spaces 2770 and a welded wire fabric 2715A to 2715C that is attached the structural element 2710, providing for the chords in the truss configuration, in the directions of the wires. Many other types of wire meshes could be used, to create different patterns of trussing systems.

Figure 25B:
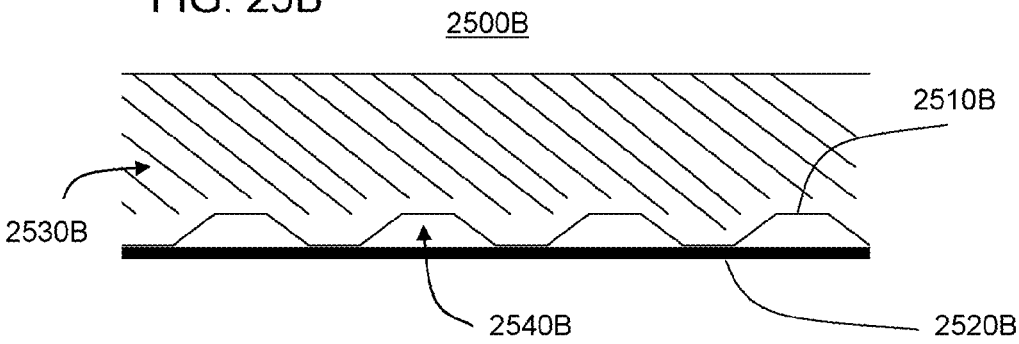
FIG. 25B is a view of a cross section of a composite element with a concrete side.

In FIG. 25B, an example of a reinforced slab 2500B including a structural element 2510B, a steel layer, steel mesh, or rebar 2520B, and a layer of concrete 2530B is illustrated. Steel layer, steel mesh, or rebar 2520B is attached to the bottom side of structural element 2510B, while the top side of structural element 2510B is covered with concrete 2530B. In some embodiments, air filled areas 2540B provide a channel structure between steel layer 2530B and structural element 2510B.

Referring again to FIG. 20A, structural elements 2005 in the walls of house 2000 can be cut to provide openings 2085 for, e.g., windows and doors or to allow cables and pipes to be fed through. Channels could be used as passageways in a roofing system such as 2050B, for locating also ducts 2070 and lighting fixtures 2075.

Also a window 2080 can itself be based on a structural element made from at least partially transparent material as shown in FIG. 20B. Similarly, as shown in FIG. 20C, a door 2090 can be based on a structural element covered by, e.g., a face-sheet 2095. Example structures of window or door configurations may include multilayer structural elements and sandwich configurations.

Figure 28:
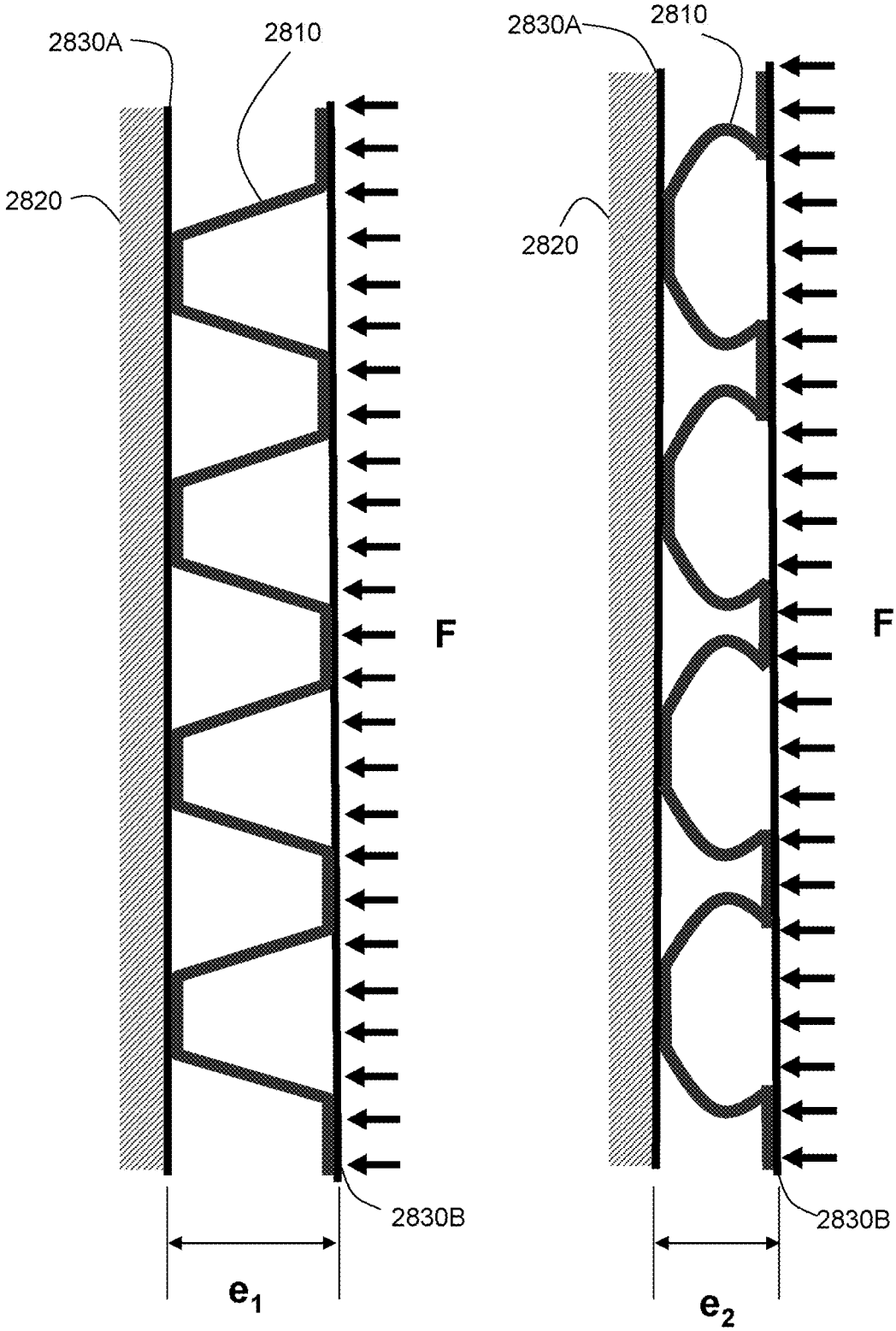
FIG. 28 is a view of a cross section of an elastically deformable structural element.

FIG. 28 shows a deformable structural element 2810 in-between two face-sheets 2830A, 2830B. Structural element 2810 is made of, e.g., elastic material that deforms when a force F is applied onto face-sheet 2830B from the relaxed state having a thickness e1 to a deformed state having a reduced thickness e2. Structural element 2810 can act, for example, as a damping element such as a shock absorber for structure 2820. The channels formed between structural element 2810 and face-sheets 2830A, 2830B can act as exhaust passageways or can be pressurized to adapt the damping characteristic.

While in most of the foregoing discussed embodiments the channels are if at all only partly filled with a material, in some embodiments most of the channel structure can also be completely filled with, e.g., a hardening material.

Moreover, with respect to the cross-section of the channel structure, the broadening of the bridge-faces makes the cross section trapezoidal-like, thereby providing a larger cross sectional area for a given separation between face-sheets and angle of the bridge-side-faces. The larger cross-section enhances properties that are a function of area. For example, it allows more volume to pass through the channel (gas, fluids) for, e.g., heating or chilling. Also, by increasing the channels, reinforcing elements with a larger cross section can be placed; a larger cross section can provide higher moment of inertia, rigidity, and strength. Similarly, more cables or conduits can be placed in the channel.

Structural elements and face-sheets can be fabricated from many different kinds of material and composite materials including metals, plastics, fiberglass laminates, aluminum and aluminum alloys, fiber and glass reinforced polymers, advanced composite materials, carbon reinforced composite materials and rubber. Other materials or combination of such materials may be chosen, depending on the particular application. Because of its continuity, structural elements may also be useful for embodiments whose strength is derived from the tensile strength of fibers, since its continuity avoid the cutting of the fibers and the need of additional bonding. This is the case, for example, in embodiments made out of, e.g., polymers reinforced with carbon fibers.

Structural elements can be formed by various manufacturing processes, including cold stretch forming, casting, molding (vacuum molding), explosive forming, thermoforming, electrolytic deposition, and welding.

It is noted that the relative ratios, angles and dimensions of the various structural elements of the embodiments described herein and shown in the figures may be adapted to the specific applications in which the structural elements are used. The size and thickness of structural elements can vary from several meters (or larger) to several nanometers (and smaller).

Angled main-faces and bridge-faces may be used in curved sandwich constructions, e.g., vehicle bodies, aircraft fuselages, ship sections, and turbine blades. As mentioned before, structural elements can be used, e.g., as anodes and cathodes in a battery cell configuration, In some embodiments, structural elements can be used for transportation and/or protection devices for substances contained in its channels and void spaces.

Structural elements are suitable for a broad variety of applications that include military, industrial and commercial components. For example, structural elements can be used for structural components for aircraft, aerospace applications, automobiles, and other vehicles. Furthermore, structural elements can be used for building structures, e.g., curtain walls, infill panels, flooring, windows, doors, pre-fabricated structural embodiments such as pre-manufactured houses, house shells, modular houses, retaining walls, stairs, concrete reinforcement, glass reinforcement, floor coverings. Furthermore, structural elements can be used for shock absorbing elements such as floor mats, shoe soles, tires, harbor shock absorbing mechanisms (when made, for example, from rubber). Furthermore, structural elements can be used for curved surface structures such as domes, submersible structures, barrels, baskets, drums. Furthermore, structural elements can be used for reinforcing materials for, e.g., bridge decks, fuselages, pipes, pressure vessels. Moreover, structural elements can be used for reinforcing different laminated products such as gypsum boards, turbine blades, aircraft wings and fuselage, boat and landing vehicle hulls. Additional applications include the formation of pallets, furniture sections, brakes, suitcases, concrete precast products, heat exchangers, fins, fuel tanks, ducts, partitions truck beds, deep sea containers, among many others.

Applications that can be based on metal embodiments include, for example, studs, H-columns and I-beams, slabs, vehicle, aircraft and vessel reinforcement. Applications that can be based on wood embodiments include core for wood-faces sandwich panels (e.g. walls, doors) and truss structure for wood flooring in multistory buildings. Applications that can be based on reinforced composite materials can include, e.g., aircraft fuselages, pressure vessels, and vehicle body parts.

In some embodiments, the symmetry of the structural element can allow stacking several elements. This can lower transportation costs when several structural elements are stacked one on top of the other. Stacking structural elements allows providing various components for a specific application to be provided in a small volume package containing all necessary components for that specific application. For example, with respect to the housing application described herein, such a package can include, e.g., walls, roof, ceiling, floor, door, window and furniture elements.

In some embodiments, the structural element can provide the same stability for smaller dimension thereby allowing, for example, to reduce the thickness of a structure or the weight of the material needed to achieve certain strength.

While several connection methods were specifically described herein, structural elements can in general be joined mechanically (by, e.g., screws, bolts, rivets, indentations, snap locks), chemically (e.g., gluing), thermally (e.g., melting or welding), or sonic.

A number of embodiments of the invention have been described. Nevertheless, it will be understood that various modifications may be made without departing from the spirit and scope of the invention. Accordingly, other embodiments are within the scope of the following claims.

What is claimed is:

1. A structural element comprising:

a continuous layer comprising a set of first main-faces defining a first surface and a set of second main-faces defining a second surface and the continuous layer extending between the first surface and the second surface, wherein along a first direction, the first main-faces and the second main-faces alternate in order and are connected by first side-faces;

along a second direction different from the first direction, the first main-faces and the second main-faces alternate in order and are connected by second side-faces; and along a third direction different from the first direction and different from the second direction, a pair of neighboring first main-faces is connected by a first bridge-face, and the first bridge-face is connected to neighboring second main-faces by first bridge-side-faces, and wherein at least one of the first bridge-faces provides a planar two-dimensional contact area to the first surface, and the first main-faces and the planar two-dimensional contact area of each first bridge-face are coplanar.

2. The structural element of claim 1, wherein a thickness of the structural element given by a distance between the first surface and the second surface is larger than a thickness of the continuous layer itself.

3. The structural element of claim 1, wherein at least one of the first bridge-faces has a width of at least 2% of a width of one of the connected first main-faces.

4. The structural element of claim 1, wherein at least one of the first side-faces is non-perpendicular with respect to at least one of its respective first main-face and its respective second main-face.

5. The structural element of claim 1, wherein each of the first bridge-side-faces extends from one of the sides of its respective first bridge-face to the side of its respective second main-face.

6. The structural element of claim 1, wherein at least one of the first main-faces, the second main-faces, the first side-faces, the second side-faces, and first bridge-side-faces is planar.

7. The structural element of claim 1, wherein at least one of the first main-faces, the second main-faces, the first side-faces, the second side-faces, and first bridge-side-faces has a curved area.

8. The structural element of claim 1, wherein at least in a partial region at least some of the first and second main-faces are tilted with respect to each other.

9. The structural element of claim 1, wherein the structural element is tubular.

10. The structural element of claim 1, wherein at least one of the first and second main-faces has one of a polygon shape, a circular shape and an elliptical shape.

11. The structural element of claim 1, wherein in the plane of the first surface, the shape of at least one of the first bridge-faces is one of rectangular, trapezoidal, polygon, and elongated having curved sides.

12. The structural element of claim 1, wherein along a fourth direction different from the first direction and different from the second direction, a pair of neighboring second main-faces is connected by a second bridge-face, and the second bridge-face is connected to neighboring second main-faces by second bridge-side-faces.

13. The structural element of claim 12, wherein the continuous layer is formed in addition to the first main-faces, the second main-faces, the first side-faces, the second side-faces, the first bridge-faces, and the first bridge-side-faces by the second bridge-faces and second bridge-side-faces.

14. The structural element of claim 12, wherein at least one of the second bridge-side-face is non-perpendicular with respect to at least one of its respective first bridge-face and its respective second main-face.

15. The structural element of claim 12, wherein at least in a partial region of the structural element the third direction and fourth direction are identical.

16. The structural element of claim 12, wherein at least in a partial region of the structural element the third direction and fourth direction are different.

17. The structural element of claim 12, wherein the third direction and fourth direction are changing from region to region of the structural element.

18. The structural element of claim 1, wherein at least one of the first main-faces, the second main-faces, the first side-faces, the second side-faces, and the first bridge-faces includes openings.

19. The structural element of claim 18, wherein the opening is configured to guide a rebar element for forming truss-configurations with the first main-faces, the second main-faces, the first side-faces, and the second side-faces or the first main-faces, the second main-faces, and the first bridge-faces.

20. A composite element comprising:

a structural element as recited in claim 1 as a continuous core component; and a first face-sheet attached to the first main-faces of the structural element.

21. The composite element of claim 20, wherein the second bridge-faces and the second bridge-side-faces of the structural element form a channel of trapezoidal cross-section with the first face sheet.

22. The composite element of claim 21, further comprising a member within the channel.

23. The composite element of claim 22, wherein the member is formed to be in contact with at least two of its respective second bridge-face and second bridge-side-face and section of the first face-sheet.

24. The composite element of claim 22, wherein the member is hollow.

25. The composite element of claim 22, wherein at least one of the first bridge-side-faces and the side-faces is configured to reflect radiation.

26. The composite element of claim 20 further comprising a second face-sheet attached to the second main-faces of the structural element.

27. The composite element of claim 20, wherein the first face-sheet is configured to transmit radiation.

28. A modular building system comprising at least one structural element as recited in claim 1, at least one face-sheet for attaching to the at least one structural element, the at least one structural element and the face-sheet configured to form a channel when attached to each other, and at least one mount element for connecting two structural elements.

29. The modular building system of claim 28, wherein the at least one mount element is one of a corner post with pins configured for inserting into the channel, a U-connector, and an angled connector structural element.

30. An open lattice structure, comprising at least two structural elements as recited in claim 1 and attached to each other at the main-faces, forming a channel system in-between the structural elements.

31. The open lattice structure of claim 30, further comprising a face-sheet in-between two neighboring structural elements.

32. The open lattice structure of claim 31, wherein the at least two structural elements are rotated with respect to each other.

33. The open lattice structure of claim 31, wherein at least two of the structural elements are structurally identical.

34. The open lattice structure of claim 31, wherein at least two of the structural elements are structurally different.

35. A structural beam, comprising:

at least one structural element as recited in claim 1; and two flanges attached to the main-faces of the structural element.

36. A structural beam as recited in claim 35, wherein the structural elements includes at least two main-faces across a width of the structural beam.

37. A wall-element comprising:

a structural element as recited in claim 1; and at least one chord element attached to the structural element for forming at least one truss-configuration with at least one of a first group of faces of the structural element including the first main-faces, the second main-faces, the first side-faces, and a second group of faces of the structural element including the second side-faces or the first main-faces, the second main-faces, the first bridge-faces, and the first bridge-side-faces.

38. The wall-element as recited in claim 37, wherein the chord element is one of a wire-mesh and a rebar.

39. The wall-element as recited in claim 38, wherein the rebar is attached to main-faces of the structural element.

40. The wall-element as recited in claim 38, wherein the rebar is positioned between the first and second main-faces of the structural element.

41. The wall-element as recited in claim 40, wherein the rebar is guided through openings within the structural element.

42. The wall-element as recited in claim 37, wherein the chord element is one of a drywall, a fiber reinforced polymer wall, a cement plate, galvanized steel, and a wood board.

43. The wall-element as recited in claim 37, wherein the chord element and the structural element form a channel system configured for inserted connectors, wherein the channel system is configured such the connectors form themselves a truss configuration.

44. A damping element comprising:

a structural element as recited in claim 1 made of elastic material and attached to two face-sheets.

45. A structural element comprising a continuous layer extending between a first surface and a second surface and formed to comprise:

truncated conical elements and truncated inverted conical elements alternating in order, wherein top main-faces of the truncated conical elements define the first surface;

bottom main-faces of the inverted truncated conical elements define the second surface;

side-faces each shared by a pair of a truncated conical element and a truncated inverted conical element;

first bridge-faces each connecting a pair of top main-faces of neighboring truncated conical elements;

first bridge-side-faces each connecting a pair of one of the first bridge-faces and the bottom main-face of a neighboring one of the inverted truncated conical elements;

second bridge-faces each connecting a pair of bottom main-faces of neighboring truncated inverted conical elements;

second bridge-side-faces each connecting a pair of one of the second bridge-faces and the top main-face of a neighboring one of the truncated conical elements, and wherein at least one of the first bridge-faces provides a planar two-dimensional contact area to the first surface, and the top main-faces and the planar two-dimensional contact area of each first bridge-face are coplanar.

46. The structural element as recited in claim 45, wherein the truncated conical elements have a pyramid-shape.

47. The structural element as recited in claim 45, wherein the top main-faces of the truncated elements, the bottom main-faces of the inverted truncated elements, the side-faces, the bridge-faces, and the bridge-side-faces form a continuous surface.

48. The structural element of claim 1, wherein at least one of the first and second main-faces has an octagon shape.

* * * * *